US010175014B2

(12) United States Patent
Kim

(10) Patent No.: US 10,175,014 B2
(45) Date of Patent: Jan. 8, 2019

(54) FIREARM LOADING SYSTEM

(71) Applicant: METTLEGUN, LLC, Laguna Niguel, CA (US)

(72) Inventor: Kyung Tae Kim, Laguna Niguel, CA (US)

(73) Assignee: METTLEGUN, LLC, Laguna Niguel, CA (US)

( * ) Notice: Subject to any disclaimer, the term of this patent is extended or adjusted under 35 U.S.C. 154(b) by 0 days.

(21) Appl. No.: 15/504,293

(22) PCT Filed: Aug. 18, 2015

(86) PCT No.: PCT/US2015/045701
§ 371 (c)(1),
(2) Date: Feb. 15, 2017

(87) PCT Pub. No.: WO2016/076931
PCT Pub. Date: May 19, 2016

(65) Prior Publication Data

US 2017/0234635 A1 Aug. 17, 2017

Related U.S. Application Data

(60) Provisional application No. 62/038,825, filed on Aug. 18, 2014, provisional application No. 62/129,834, filed on Mar. 7, 2015.

(51) Int. Cl.
*F41A 9/41* (2006.01)
*F41A 9/59* (2006.01)

(52) U.S. Cl.
CPC . *F41A 9/41* (2013.01); *F41A 9/59* (2013.01)

(58) Field of Classification Search
USPC ..... 89/190
See application file for complete search history.

(56) References Cited

U.S. PATENT DOCUMENTS 3,715,826 A * 2/1973 Seifried ..... F41A 17/36 42/70.06
4,420,899 A * 12/1983 Bourlet ..... F41A 9/59 42/70.02
4,594,935 A * 6/1986 Smith ..... F41A 17/36 42/75.02
5,131,317 A * 7/1992 Meller ..... F41A 17/36 89/138
5,473,834 A * 12/1995 Bammate ..... F41A 9/59 42/50

(Continued)

*Primary Examiner* — Bret Hayes
(74) *Attorney, Agent, or Firm* — Fish IP Law, LLP

(57) ABSTRACT

A firearm reload system that enables the reloading of a firearm with a single user action. The firearm reload system can include an automatic ammunition chambering system and an empty magazine auto-eject system. The automatic ammunition chambering system includes an actuator on a magazine that actuates a pivoting slide lock when the magazine is introduced into the firearm frame, causing the pivoting slide lock to disengage from the firearm's slide release, thereby freeing the slide and chambering a cartridge. The magazine auto-eject system includes a magazine actuator linking the slide release and the magazine release such that when the slide release is brought into a locked position, the magazine actuator actuates the magazine release such that the magazine is released from the firearm.

19 Claims, 32 Drawing Sheets

(56) References Cited

U.S. PATENT DOCUMENTS

| | | | | |
|---|---|---|---|---|
| 6,408,905 | B1 | 6/2002 | Lee | |
| 6,606,811 | B1 * | 8/2003 | Olson | F41A 17/36 42/50 |
| 6,898,888 | B2 | 5/2005 | Greenhut | |
| 8,033,043 | B2 | 10/2011 | McGarry | |
| 8,061,255 | B1 | 11/2011 | Boberg | |
| 2010/0170132 | A1 | 7/2010 | Zukowski | |
| 2010/0170138 | A1 | 7/2010 | Zukowski | |
| 2015/0033608 | A1 * | 2/2015 | Power | F41A 9/59 42/6 |
| 2016/0069627 | A1 * | 3/2016 | Cobb | F41A 17/36 42/70.02 |

* cited by examiner

Figure 2 (prior art)
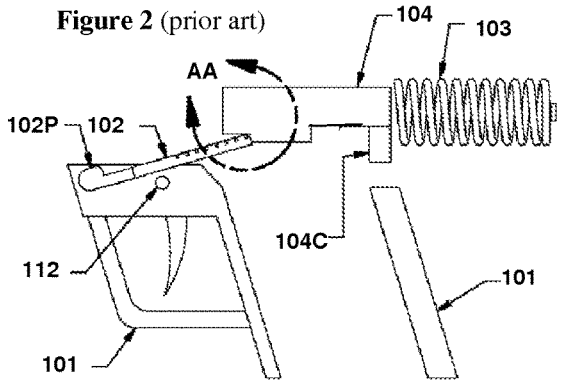
Figure 2A (prior art)
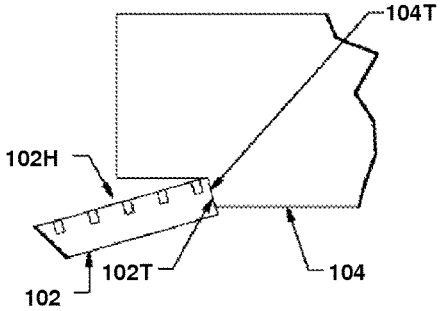
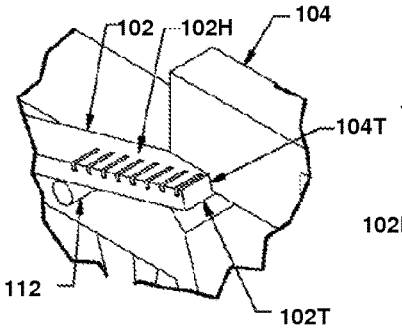
Figure 3A (prior art)
Figure 3 (prior art)
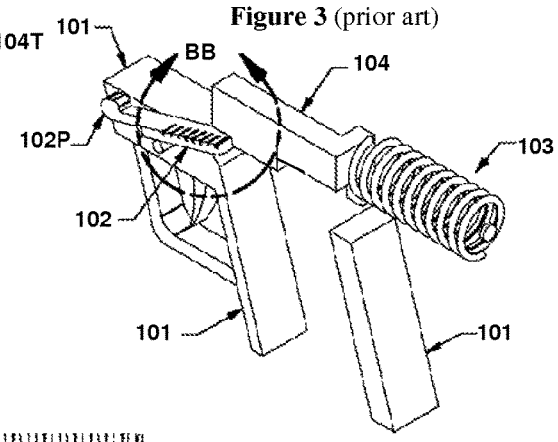
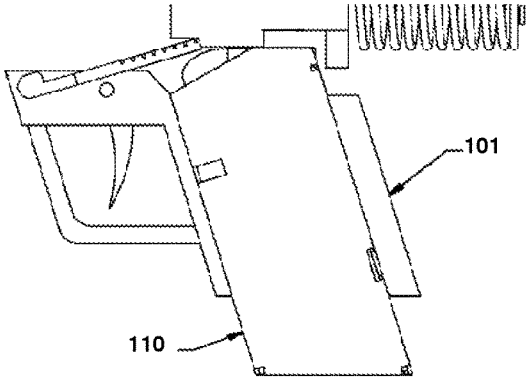
Figure 4 (prior art)

Figure 5 (prior art)
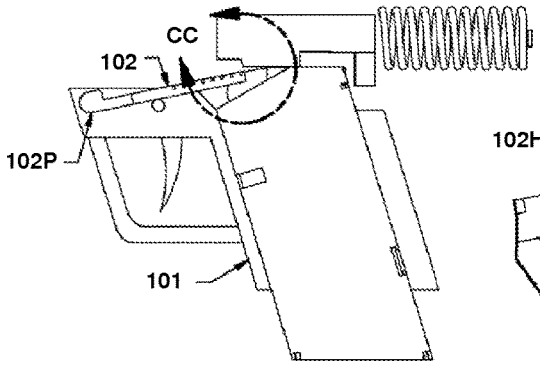
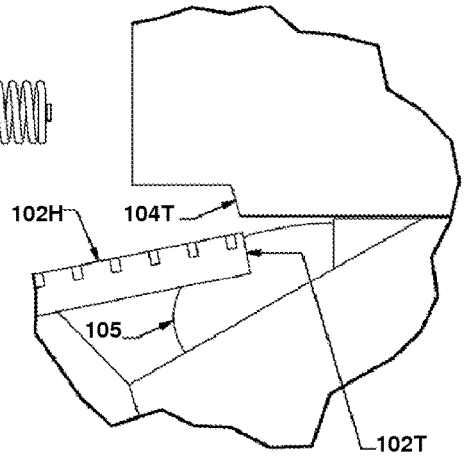
Figure 5A (prior art)
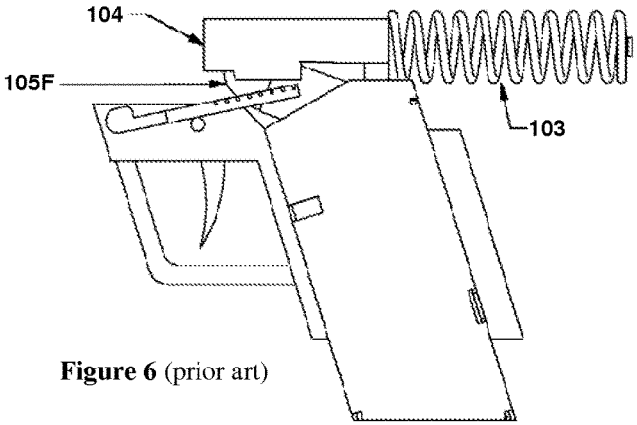
Figure 6 (prior art)
Figure 7 (prior art)
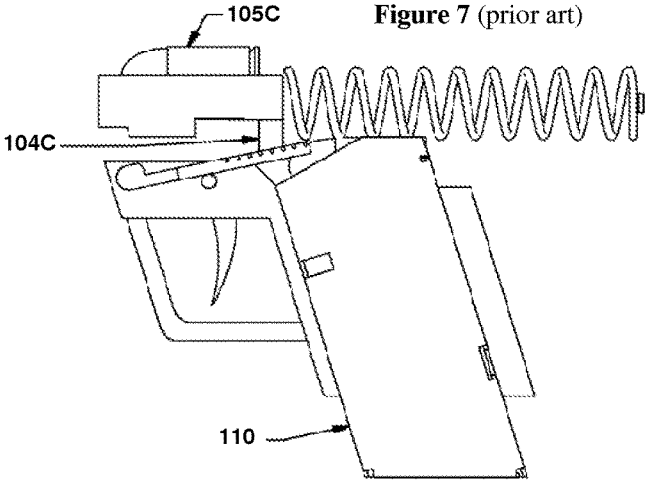

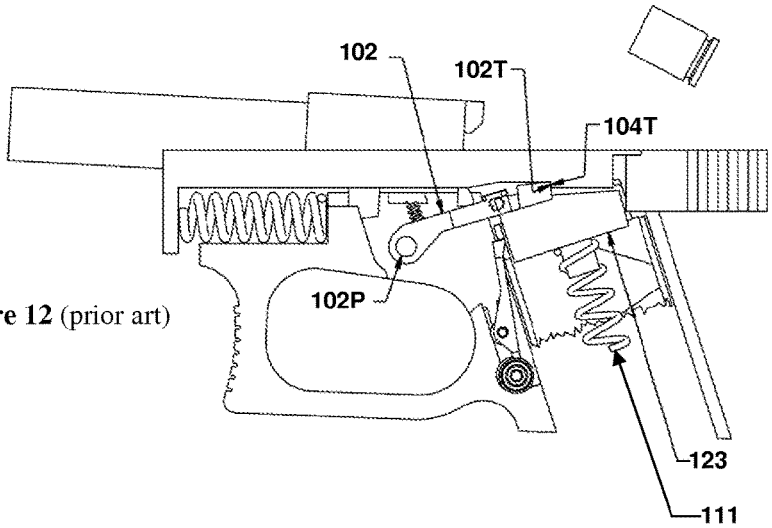
Figure 12 (prior art)
Figure 16 (prior art)
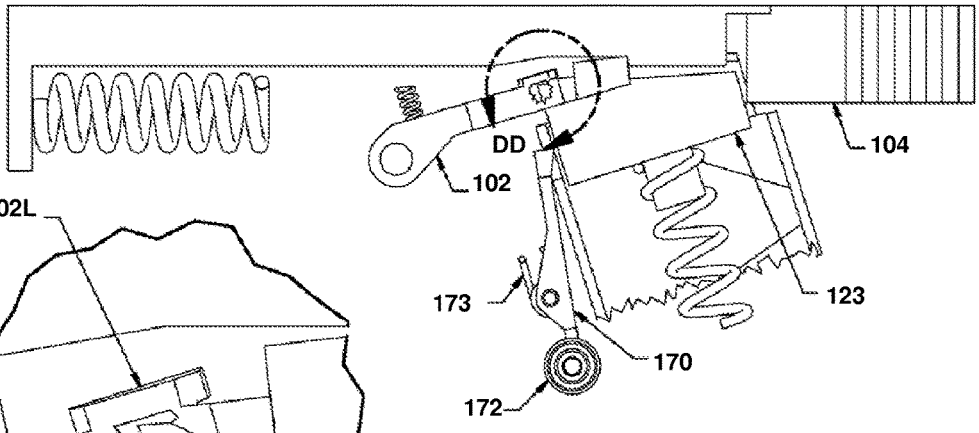
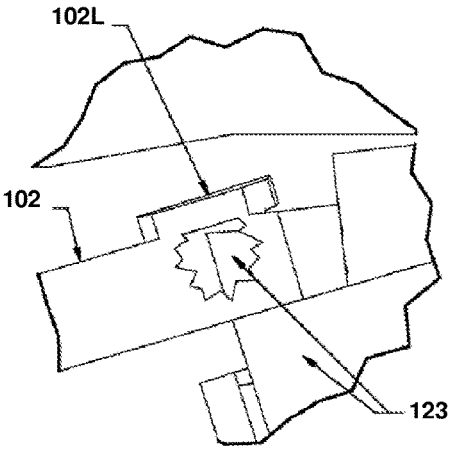
Figure 17 (prior art)
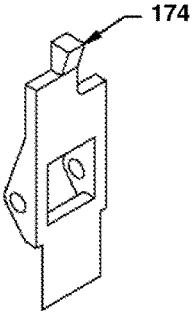
Figure 18 (prior art)

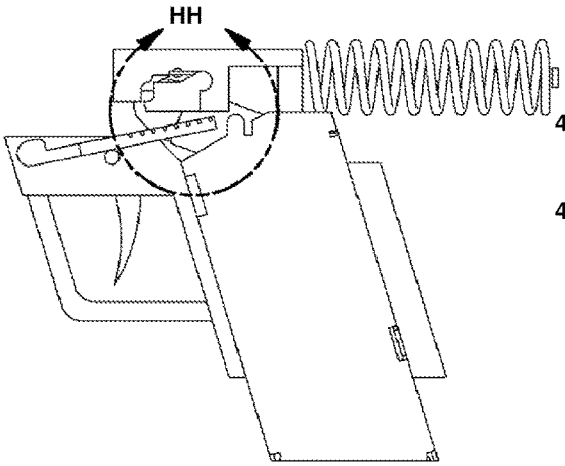
Figure 30
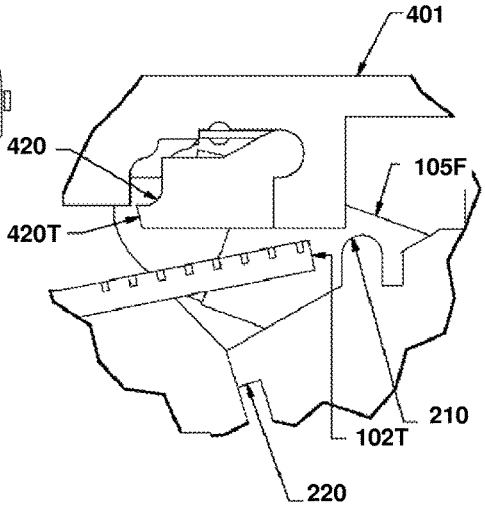
Figure 30A
Figure 32
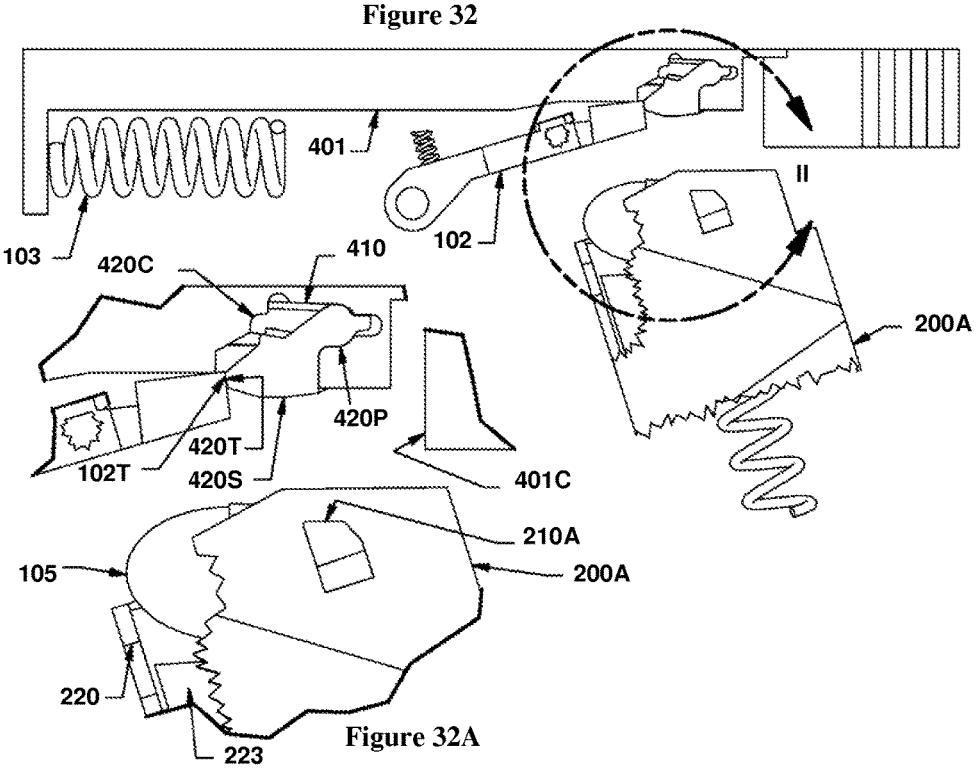
Figure 32A

FIREARM LOADING SYSTEM

This application claims priority to U.S. provisional application 62/038,825, filed Aug. 18, 2014 and U.S. provisional application 62/129,834, filed Mar. 7, 2015. U.S. provisional applications 62/038,825 and 62/129,834, and all other extrinsic references contained herein are incorporated by reference in their entirety.

FIELD OF THE INVENTION

The field of the invention is firearm reloading technologies.

BACKGROUND

The background description includes information that may be useful in understanding the present invention. It is not an admission that any of the information provided herein is prior art or relevant to the presently claimed invention, or that any publication specifically or implicitly referenced is prior art.

Firearms are common in conflict scenarios such as in combat, law enforcement, and home defense. These scenarios typically develop and transpire quickly, and a user's survival can depend on their ability to ascertain a situation, ready their weapon, and discharge the weapon as needed. Thus, in these scenarios, even fractions of a second can mean the difference between life and death. Additionally, these scenarios are usually high-stress scenarios, which can affect a user's ability to concentrate clearly or react.

Many modern firearms, including pistols, are semi-automatic firearms. A semiautomatic firearm keeps its slide (cartridge chambering mechanism) locked back/open after all ammunition is expended. Readying an empty semi-automatic firearm requires the user to perform at least two, distinct steps: (1) inserting the magazine into the frame of the firearm and (2) pulling back and releasing the slide (referred to as "racking" or "slingshoting" the slide) to load a round into the chamber (or by manually releasing the slide by actuating the slide release, if the slide is initially locked) via the forward movement of the slide under the force of a compressed main spring. Replacing an empty magazine with one having ammunition requires at least three steps: (1) releasing the empty magazine, (2) inserting the new magazine, and (3) unlocking the locked slide by either racking the slide or manually releasing the slide via the slide release.

Unfortunately, in a high-stress conflict situation this multi-step process can take away valuable response time, even for experienced users. Additionally, a process of greater complexity requires greater concentration from a user, and introduces greater opportunity for user error. Thus, in such a situation, requiring multiple steps to ready the firearm requires the user to remove their attention from the situation at hand, for a longer period of time, and introduces multiple opportunities for the user to hesitate or commit an error during the process.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

The following description includes information that may be useful in understanding the present invention. It is not an admission that any of the information provided herein is prior art or relevant to the presently claimed invention, or that any publication specifically or implicitly referenced is prior art.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Thus, there is still a need for systems and methods of simplifying the process of loading and unloading a firearm.

SUMMARY OF THE INVENTION

The inventive subject matter provides apparatus, systems and methods that reduces the number of user steps required to reload an empty firearm.

The inventive subject matter includes an automatic ammunition chambering system and a magazine auto-eject system that respectively simplify the process of loading and unloading a firearm for a user. Via the systems and methods of the inventive subject matter, the requirement of any user action for the unloading an empty magazine is eliminated and the required user actions during the loading of a new magazine is reduced to a single step. Thus, the reloading sequence of the firearm can be reduced from three (or more) user-executed steps to one user-executed step.

The automatic ammunition chambering system of the inventive subject matter includes a frame assembly and a magazine that enable the automatic release of the slide upon the insertion of a magazine into a firearm frame, chambering a cartridge and leaving the firearm in a ready-to-fire state.

The frame assembly includes a pivoting slide lock coupled to the frame such that the pivoting slide lock is biased (such as via a spring) downward into a "lock" position. While in the lock position, the pivoting slide lock can contact the slide release of the firearm when the slide release of the firearm is raised from a slide release unlock position to a slide release lock position, keeping the slide locked. The pivoting slide lock can be pivotably attached to the slide and be disposed within a pivoting slide lock cavity of the frame.

The magazine includes a pivoting slide lock actuator that is configured to, when the magazine is introduced into the slide-locked firearm, align with the pivoting slide lock. As the magazine becomes fully inserted, the actuator of the magazine contacts the pivoting slide lock, and causes it to pivot upward to an unlock position. This pivoting to an unlock position disengages the pivoting slide lock from the slide release, freeing the slide to move forward and chamber a round from the magazine.

The magazine auto-eject system of the inventive subject matter includes a magazine actuator that links the slide release with the magazine release of the firearm, such that causing the firearm to go into a "slide-locked" mode (such as by the follower of an empty magazine) causes the magazine release to disengage from the magazine, causing the magazine to be ejected.

The slide release can include an elongated hole that allows the slide release to travel as it becomes locked and, conversely, as it is released from being locked.

The magazine actuator and magazine release are separably coupled. In embodiments, the auto-eject system will include a disable knob that can be used to separate the actuator from the magazine release, thus reverting the firearm's release mechanism to require manual actuation via a release button.

In embodiments the magazine actuator and magazine release are disconnected after the ejection of the magazine and as such, the magazine release is automatically, and nearly instantaneously, returned to a "ready to secure" position capable of securing a new magazine.

In other embodiments, the magazine actuator and magazine release do not become disconnected after the ejection of the magazine unless the disable knob is actuated. Thus, the slide must be unlocked for the magazine release to reset to a position to secure a new magazine.

In embodiments, the automatic ammunition chambering system and magazine auto-eject system can be combined into a single firearm that allows the user to eject an empty magazine, load a new magazine and chamber a cartridge with only a single required user action—the insertion of the new magazine.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIGS. 2-3A illustrate a prior art semiautomatic firearm in it's out of ammunition state with slide locked.

FIGS. 4-5A illustrate a prior art firearm with a prior art magazine fully inserted into frame with a cartridge ready to be chambered.

FIG. 6 shows the prior art firearm with the slide beginning to move forward to chamber a cartridge.

FIG. 7 shows the prior art firearm with the chambered cartridge.

FIG. 12 shows the firing of the last cartridge by the prior art firearm.

FIG. 16 is a close-up of FIG. 12.

FIG. 17 is a close-up of a section of FIG. 16.

FIG. 18 shows a prior art magazine release.

FIGS. 30-31 illustrate the pivoting slide lock of the inventive subject matter disengaged from the slide release.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Figure 1A:
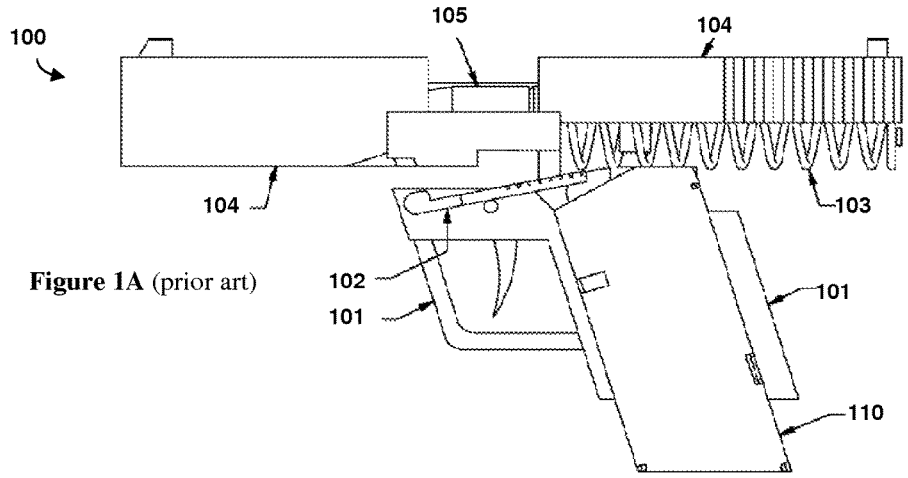
Figure 1A (prior art)
FIG. 1A is an example of a semi-automatic pistol of the prior art.
Figure 1B:
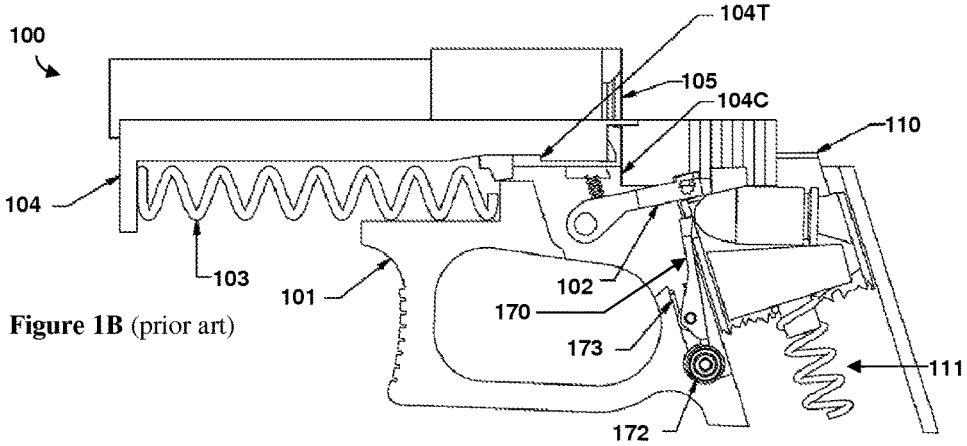
Figure 1B (prior art)
FIG. 1B is another example of a semi-automatic pistol of the prior art.

FIGS. 1A and 1B are illustrative examples of semiautomatic firearms 100 in a ready to fire state. As shown in FIGS. 1A and 1B, semiautomatic firearm 100 includes frame 101, slide release 102, main spring 103, slide 104, and are shown with an inserted magazine 110 and a cartridge 105 chambered and ready to fire. FIG. 1B illustrates a prior art firearm 100 having a forward-disposed main spring 103 whereas FIG. 1A illustrates a prior art firearm 100 having a rearward-disposed main spring 103. It should be noted that certain components illustrated in certain figures have been omitted from other figures for illustrative clarity only.

FIGS. 2-3A illustrate a prior art semiautomatic firearm 100 (in this example, the firearm 100 of FIG. 1A) in it's out of ammunition state with slide 104 locked. Slide release 102 pivots about its slide release pivot 102P in frame 101. In FIG. 2, the slide release 102 is shown pivoted upward, engaging slide 104 and thus locking slide 104 in place. This is illustrated in greater detail in FIG. 2A, corresponding to section AA of FIG. 2. As shown in FIG. 2A, the slide release 102 includes a slide release tip 102T that, when slide release 102 is pivoted upward, interfaces with a slide locking notch 104T of a slide 104 which is forwardly biased (toward the left in this illustration) by compressed main spring 103. The force provided by main spring 103 causes the slide locking notch 104T to contact the slide release tip 102T of slide release 102, and prevents slide release tip 102T from disengaging slide locking notch 104T once they make contact. The interplay between slide release tip 102T of slide release 102 and slide locking notching 104T of slide 104 can be collectively referred to as the slide locking mechanism. The slide release 102 in the upward pivoted position can be considered to be its "locked" position. FIGS. 3 and 3A provide an isometric perspective of the components described in FIGS. 2 and 2A, with FIG. 3A corresponding a close-up of section BB illustrated in FIG. 3.

FIGS. 4-5A illustrate firearm 100 with a prior art magazine 110 fully inserted into frame 101 with a cartridge 105 ready to be chambered (i.e., ready to be moved into the firing position). In FIG. 4, the slide 104 is still in the locked position.

FIGS. 5-5A illustrate the disengagement of the slide locking mechanism by the depression of slide release 102 by a force (usually by the user's thumb) applied to a slide release pressing area 10211. As shown in greater detail in FIG. 5A (a closer view of section CC of FIG. 5), slide release pressing area 10211 can be a serrated area of slide release 102 (also shown in detail in FIGS. 2A and 3A). The applied force causes slide release 102 to pivot downward about its slide release pivot 102P (to its "unlocked" position). This in turn disengages slide release tip 102T from slide locking notch 104T. The slide 104 is now free to travel forward due to the force of compressed main spring 103.

As shown in FIG. 6, slide 104 begins to move forward and as the slide 104 moves forward, slide chambering notch 104C (visible in FIG. 2) engages the back of a cartridge 105 and initially moves the cartridge 105 into the feeding position 105F and ultimately into the chambered (firing) position 105C (FIG. 7) in the barrel (barrel not shown for illustrative clarity).

Figure 8:
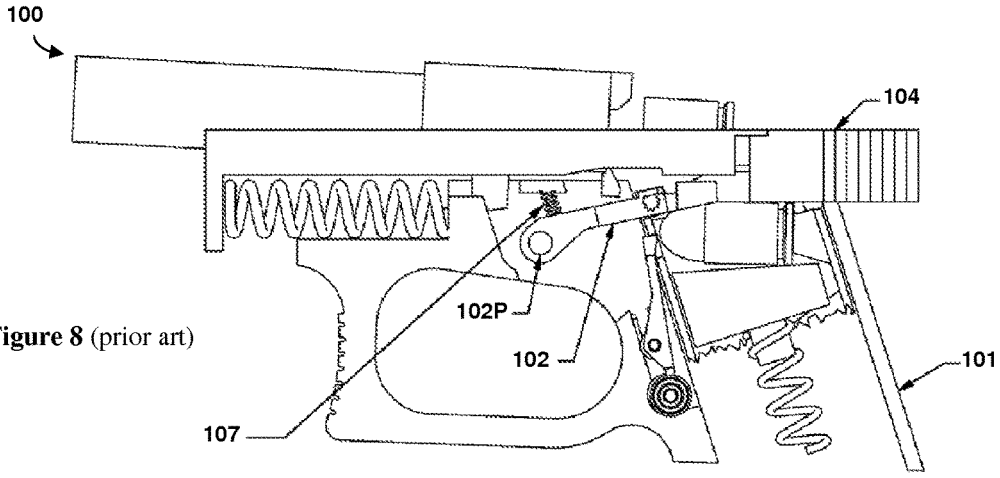
Figure 8 (prior art)
FIG. 8 illustrates prior art firearm beginning to cycle after firing.
Figure 9:
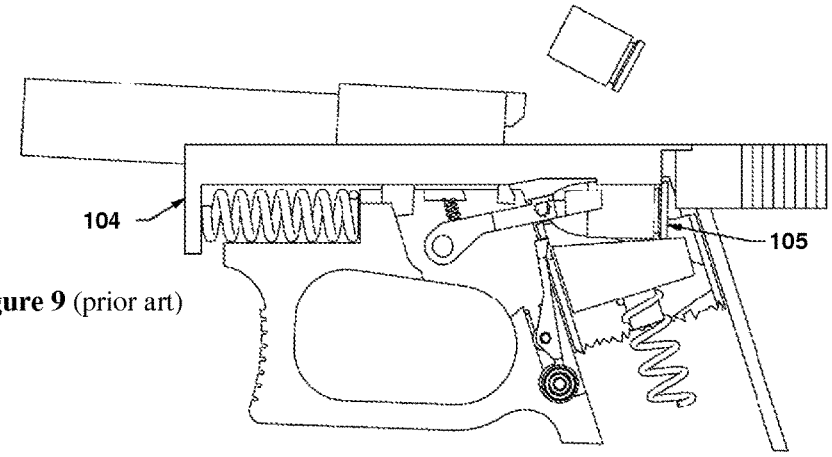
Figure 9 (prior art)
FIG. 9 shows the slide of prior art firearm in a fully recoiled position.
Figure 10:
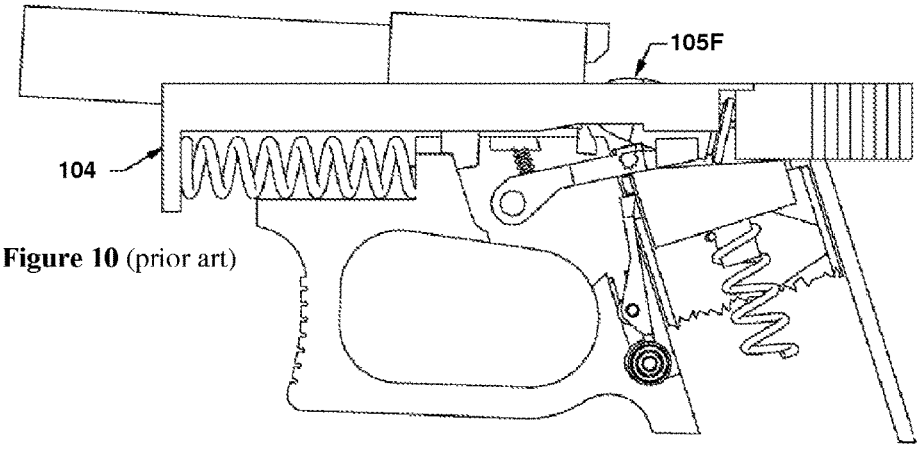
Figure 10 (prior art)
FIG. 10 shows the prior art firearm with a new cartridge being chambered.
Figure 11:
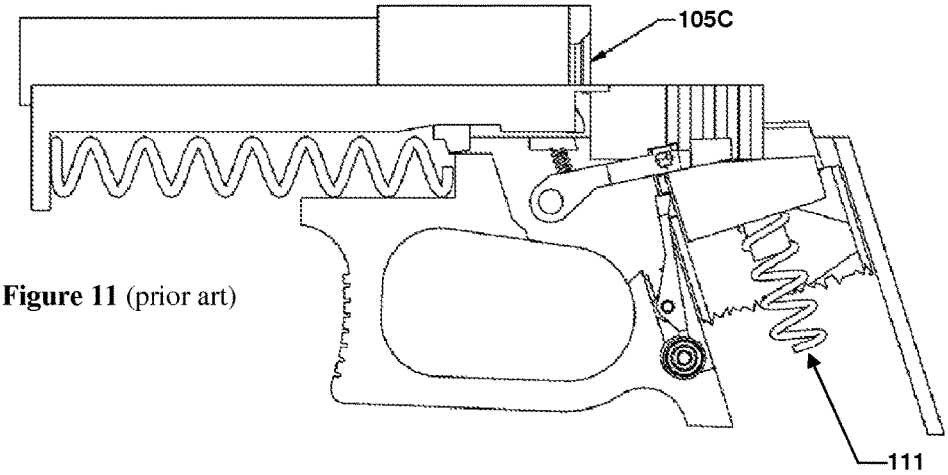
Figure 11 (prior art)
FIG. 11 shows the cartridge of FIG. 10 in the firing position.

FIG. 8 illustrates prior art firearm 100 (in this illustrative example, firearm 100 illustrated in FIG. 1B) beginning to cycle after firing. The firearm 100 of FIG. 1B is shown as having one cartridge 105 chambered, and one remaining in the magazine 110. Thus, in FIG. 8, the empty shell of the just-fired cartridge is about to be expelled as the slide 104 begins to move backward by the recoil of the firing. Firearm 100 of FIG. 8 (and FIG. 1B) is also shown having a spring 107 that biases the slide release 102 downward so that the slide release 102 does not inadvertently pivot upward and lock slide 104 before the magazine 110 is emptied (such as if the firearm 100 is being fired upside-down). In FIG. 9, the slide 104 of prior art firearm 100 is fully recoiled. The spent cartridge shell is ejected, and the next cartridge 105 (in this example, the last one in the magazine 110) is pushed upward to the top of the magazine 110 (up against the open lips of the magazine 110). This cartridge 105 is then ready to be chambered, and is chambered from feeding position 105F by the subsequent return of the slide 104 (caused by the expansion of compressed main spring 103) as shown in FIG. 10. As shown in FIG. 11, the cartridge 105 is in firing position 105C. Thus, the actions illustrated in FIGS. 10-11 are the same as those illustrated in FIGS. 6-7.

Figure 19:
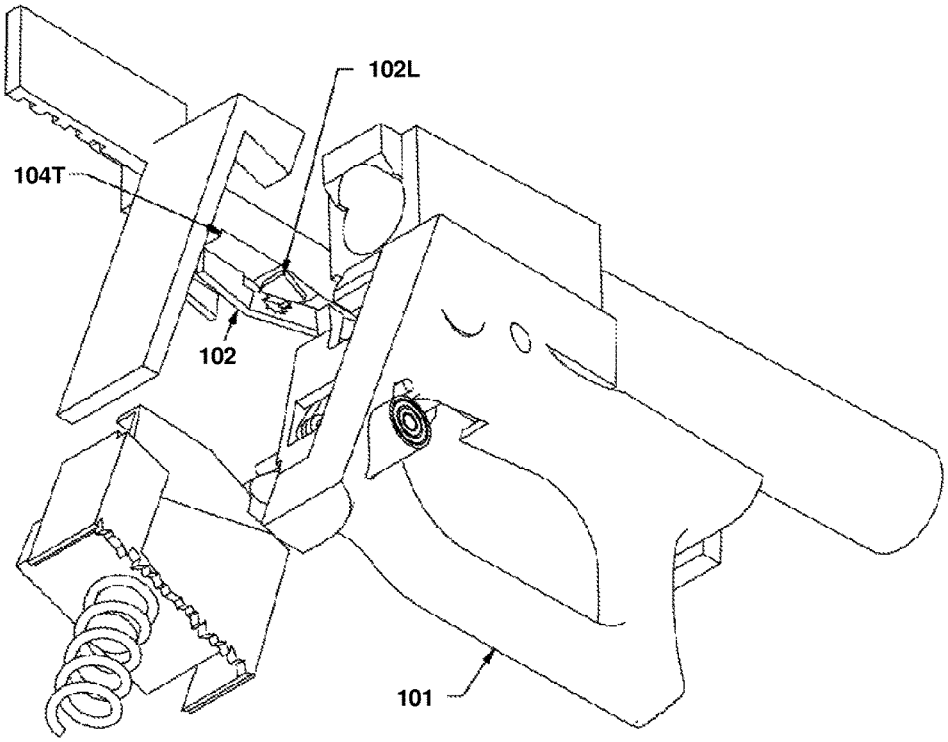
Figure 19 (prior art)
FIG. 19 provides a perspective of the magazine follower activation ledge of the prior art firearm.

Upon firing the last cartridge 105, the slide 104 recoils and the empty cartridge is ejected as shown in FIG. 12. During this action, magazine spring 111 forces magazine follower 123 upward such that magazine follower 123 contacts slide release 102, overcoming the force exerted by spring 107 and pivoting slide release 102 upward such that the extension of main spring 103 causes slide locking notch 104T to contact slide release tip 102T, locking slide 104. FIG. 16 provides a close-up of FIG. 12 in further detail, with certain components of firearm 100 omitted for purposes of illustrative clarity. FIG. 17 illustrates a close-up of section DD of FIG. 16, showing the interaction between the magazine follower 123 and the slide release 102. In the example illustrated in FIG. 17, slide release 102 includes a magazine follower activation ledge 102L that extends into the firearm 100 such that magazine follower 123 contacts activation ledge 102L, causing slide release 102 to pivot upward. In FIGS. 16-17 (and other figures), slide release 102 is illustrated with a perforation to permit showing the mechanisms described herein with greater clarity. FIG. 19 provides a perspective from the opposite side of the firearm 100 of the magazine follower activation ledge 102L. As shown in FIG. 19, the activation ledge 102L extends into the firearm 100 such that magazine spring 111 will cause the magazine follower 123 to contact the activation ledge 102L when the magazine is emptied.

Figure 13:
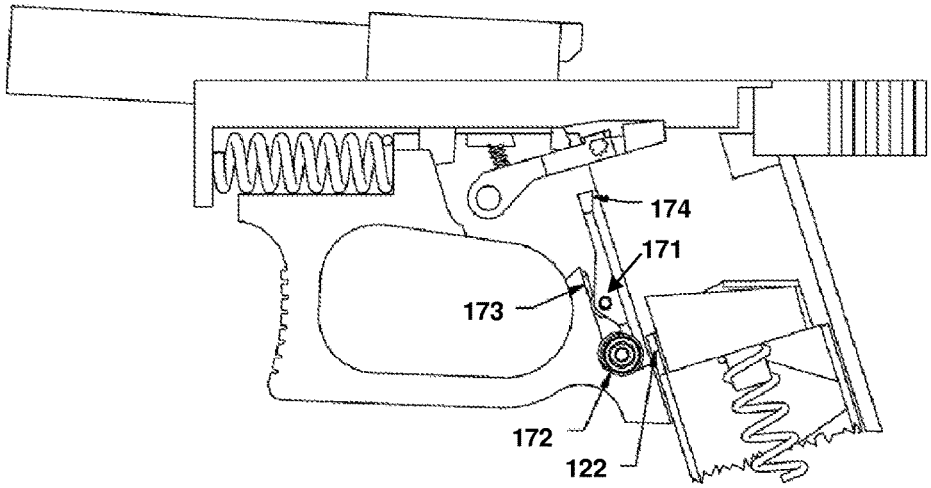
Figure 13 (prior art)
FIG. 13 illustrates the ejection of a magazine from the prior art firearm.
Figure 14:
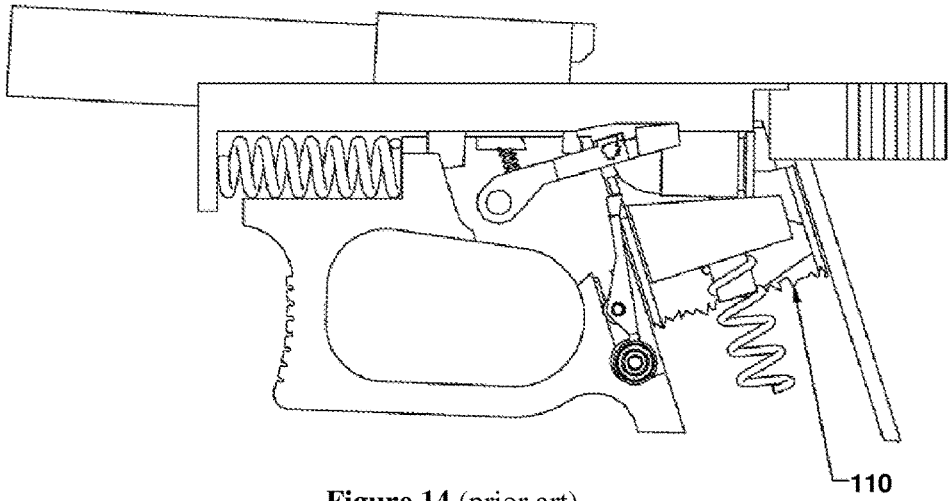
Figure 14 (prior art)
FIG. 14 illustrates the introduction of a new magazine into the prior art firearm.
Figure 15:
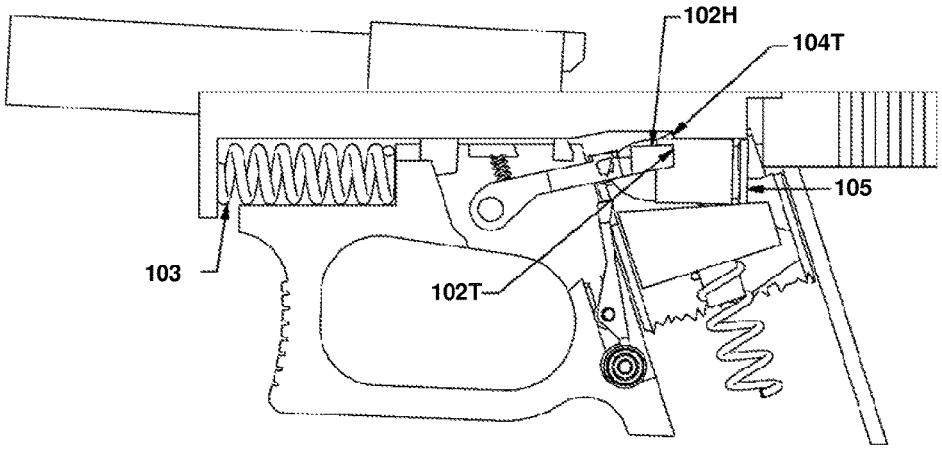
Figure 15 (prior art)
FIG. 15 shows the prior art firearm with the slide release actuated.

Magazine release 170 is normally biased in a closed position by magazine release spring 173. To release the empty magazine 110, a user depresses magazine release button 172. The depression of magazine release button 172 interacts with the magazine release 170 such that the magazine release 170 pivots about magazine release pivot 171 such that magazine release notch 174 is no longer engaged with magazine notch 122, as shown in FIG. 13. As in FIG. 4, FIG. 14 illustrates a newly-inserted magazine 110 having a cartridge into prior art firearm 100, with the slide 104 locked in place by slide release 102. FIG. 15 shows the firearm 100 just after the slide release 102 has been actuated downward, such as via the user's thumb acting upon slide release pressing area 10211 or via a "sling shot" of the slide 104 by the user. Having been released, the slide 104 proceeds forward under the force of main spring 103 and chambers the cartridge 105 for firing as shown in FIGS. 5-7 and 9-11.

As can be appreciated by one of ordinary skill in the art, the firearms 100 of FIGS. 1A and 1B (and the other prior art figures) have some differences in terms of their respective layouts and the exact shapes and/or dimensions of various components therein. These examples are presented to illustrate, as can be appreciated by one of ordinary skill in the art, that the prior art processes, mechanics, and components involved in loading a magazine 110 into the frame 101, unlocking the slide 104 (to thereby chamber a cartridge 105), discharging a cartridge 105 such that a new cartridge 105 is chambered (if any remain in magazine 110), discharging the last cartridge 105 in a magazine 110 such that the slide 104 is caused to go into the locked position, and ejecting an empty magazine 110 are common to many semiautomatic firearms beyond those illustrated herein.

Figure 20:
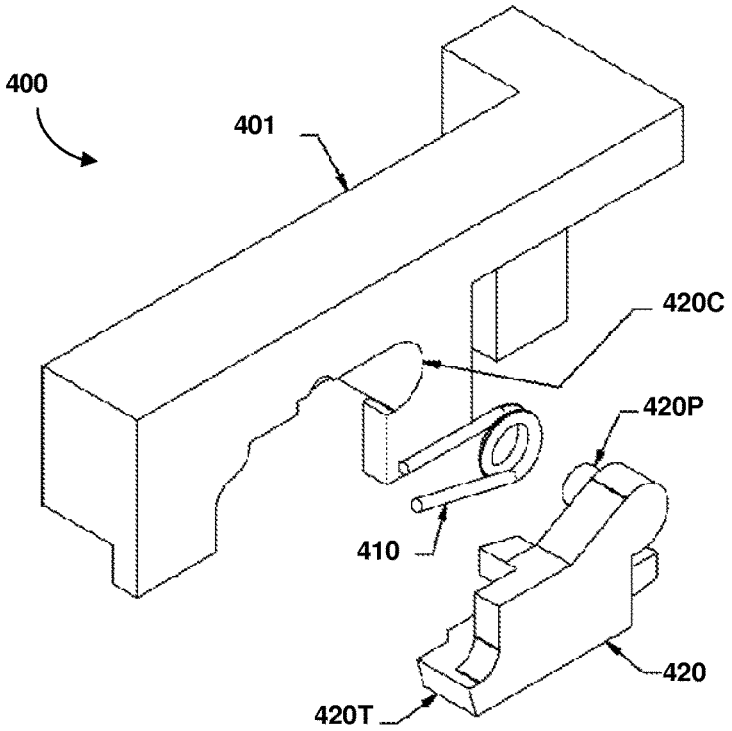
FIGS. 20 and 22 are exploded views of the slide assembly of the inventive subject matter.
Figure 21:
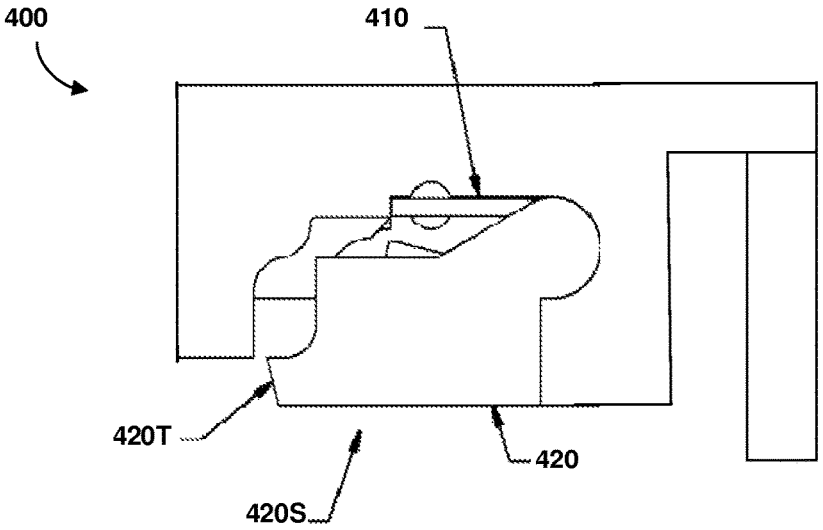
FIG. 21 is a side view of the slide assembly of FIGS. 20 and 22.
Figure 22:
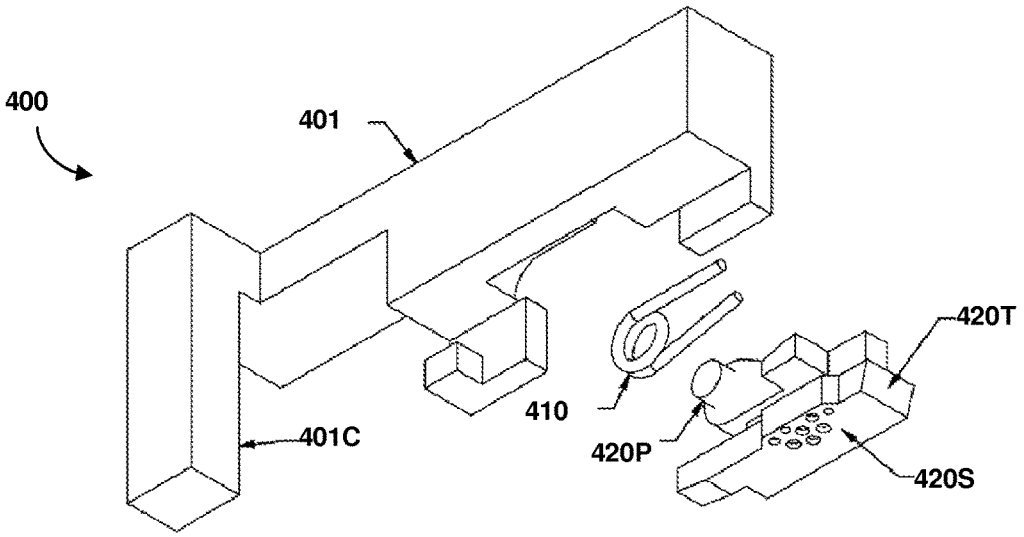

FIGS. 20-22 illustrate exploded views of the slide assembly 400 of an automatic ammunition chambering system and its constituent components, according to an embodiment of the inventive subject matter. As shown in FIGS. 20-22, slide assembly 400 includes a pivoting slide lock 420, a pivoting slide lock spring 410, and cavity 420C in slide 401. The pivoting slide lock 420 includes slide lock pivot 420P that fits through pivoting slide lock spring 410 when the pivoting slide lock 420 is inserted (along with spring 410) into the cavity 420C. The pivoting slide lock 420 also includes a pivoting slide lock notch 420T and a pivoting slide lock actuation surface 420S. Pivoting slide lock spring 410 biases downward pivoting slide lock 420 such that unless the pivoting slide lock 420 is pushed upward, the pivoting slide lock notch 420T is exposed and ready to interface with slide release 102. Slide 401 also includes slide chambering notch 401C, which functions in the same manner as slide chambering notch 104C of a prior art slide 104 to chamber a cartridge 105 when slide 401 moves forward.

It should be noted that the slide assembly 400 of the inventive subject matter will interface with a firearm frame 101 of a standard semiautomatic firearm 100 in the same manner as a prior art slide 104. In other words, no modifications to the frame 101 are required to replace prior art slide 104 with the slide assembly 400 of the inventive subject matter.

Figure 23:
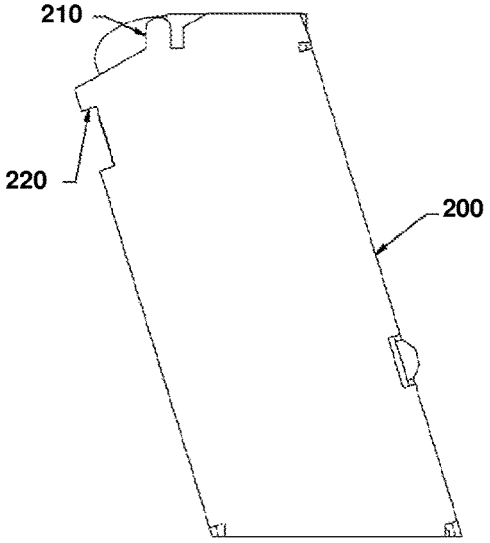
FIGS. 23-25 are views of the magazine having a slide lock actuator of the inventive subject matter.
Figure 24:
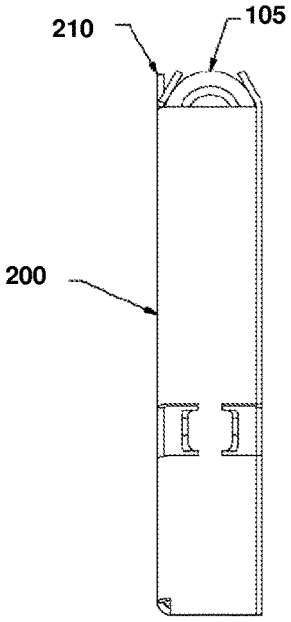
Figure 25:
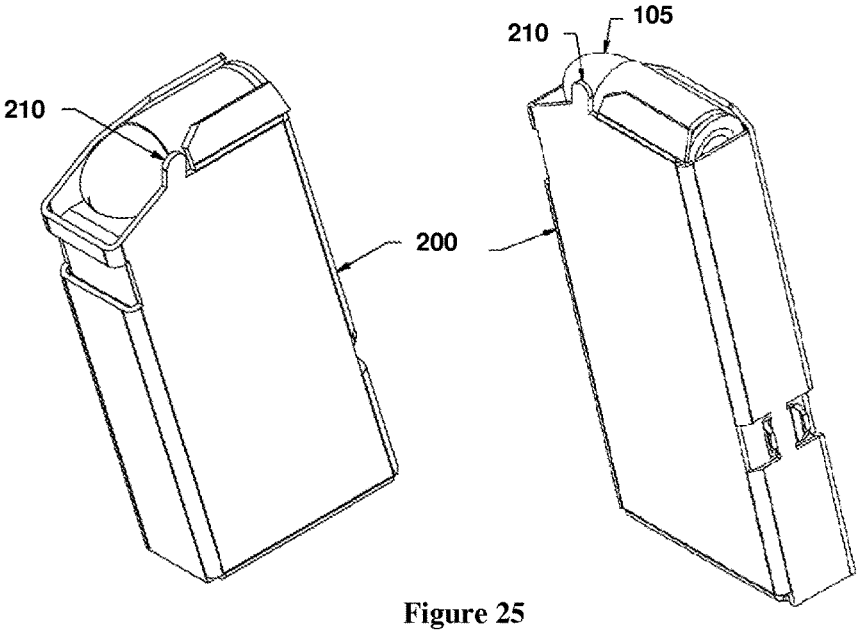

FIGS. 23-25 provide multiple views of a magazine 200 of the automatic ammunition chambering system according to an embodiment of the inventive subject matter. As shown in FIGS. 23-25, magazine 200 includes a pivoting slide lock actuator 210 (in the form of projecting tab) extending vertically from the upper end of the left side wall of magazine 200 and a magazine notch 220. However, it is contemplated that the pivoting slide lock actuator 210 can be located at any point along upper end of the sides of magazine 200 such that the pivoting slide lock actuator 210 is in alignment with the pivoting slide lock 420 of slide assembly 400 when the magazine 200 is inserted in to frame 101.

Figure 26:
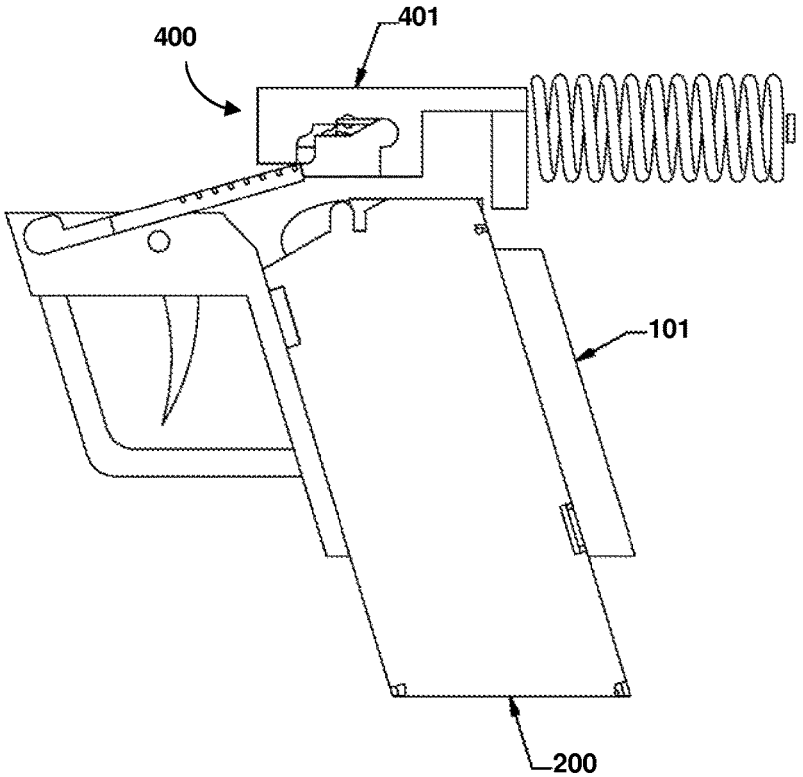
FIGS. 26-27A illustrate the pending interplay between the slide assembly and the magazine of the inventive subject matter.
Figure 27:
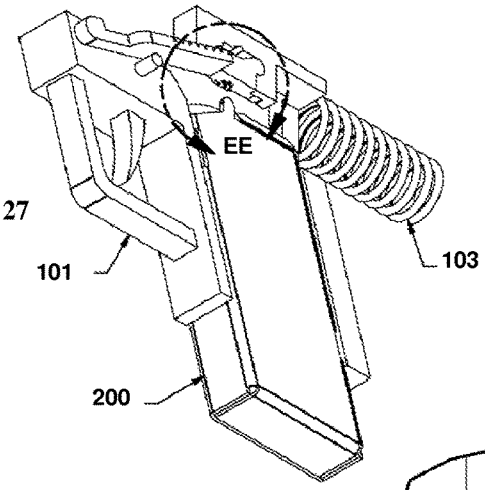
Figure 27A:
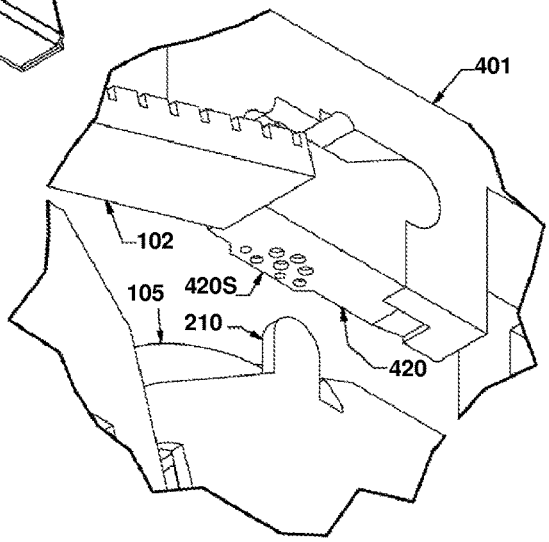

FIGS. 26-27A illustrate the pending interplay between the assembled slide assembly 400 and magazine 200. This interplay is considered "pending" because, as illustrated in FIGS. 26-27A, magazine 200 is partially inserted into the magazine well (cavity) of firearm frame 101 and is about to (but has not yet) be pushed up such that the pivoting slide lock actuator 210 of magazine 200 engages pivoting slide lock actuation surface 420S (shown with "cheese-holed" section for illustrative clarity) of pivoting slide lock 420. FIG. 27A is a close-up of section EE of FIG. 27.

Figure 28:
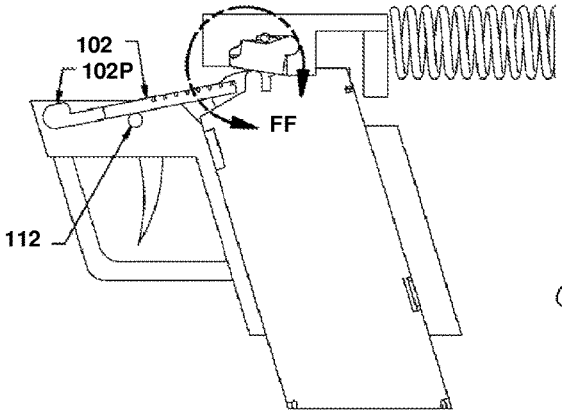
FIGS. 28-29A illustrate the interplay between the fully inserted magazine, the pivoting slide lock and the slide release, of the inventive subject matter.
Figure 29:
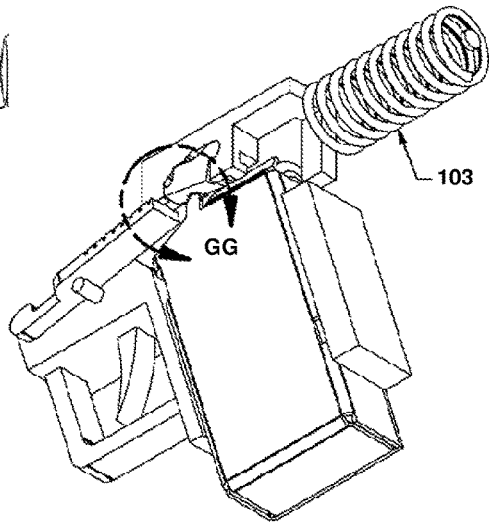
Figure 28A:
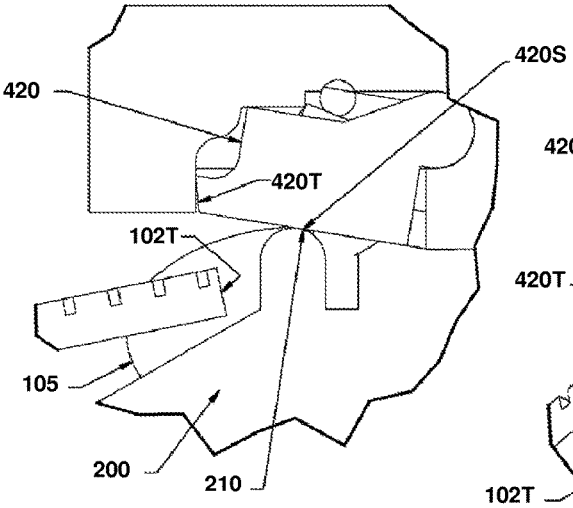
Figure 29A:
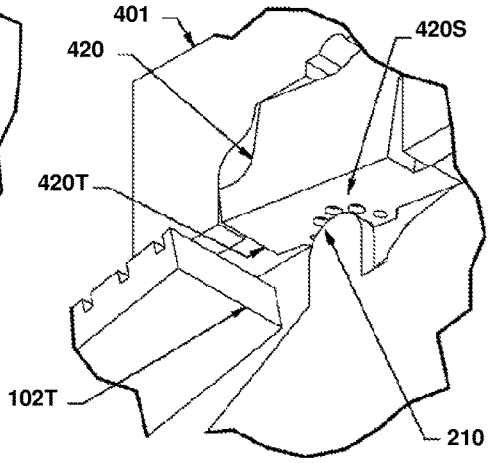

FIGS. 28-29A illustrate the interplay between a fully inserted magazine 200, pivoting slide lock 420 and slide release 102. As pivoting slide lock actuator 210 pushes up against pivoting slide lock actuation surface 420S, pivoting slide lock 420 pivots clockwise (in this illustration) about its pivot 420P (shown in FIGS. 20, 22). This pivoting action clears pivoting slide lock notch 420T from slide release tip 102T of slide release 102. Slide release 102 in turn rotates down about slide release pivot 102P (under a bias force provided by its own spring, such as spring 107 illustrated in FIG. 8, or via gravity) and comes to rest against slide release rest 112.

Figure 31:
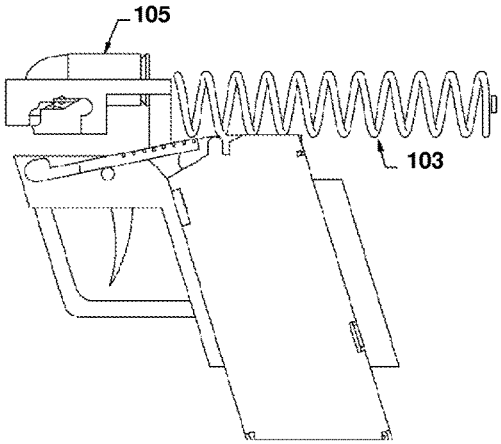

In existing firearms 100, a magazine 110 will typically be inserted until it is held in place by a "catch" mechanism that keeps the magazine 110 from falling out. In the illustrated example of FIG. 1B (omitted for clarity in FIG. 1A, though applicable to that example as well), an inserted magazine 110 is held in place by the engagement of the magazine release notch 174 of magazine release 170 with magazine notch 122. In this interplay between the magazine release notch 174 and magazine notch 122 there exists a tolerance such that during a full insertion of the magazine 110 (which can, in certain firearms, be limited or controlled by a frame magazine insertion limit notch of frame that is contacted by a corresponding magazine insertion limit notch on the magazine itself, as known in the art), the magazine notch 122 will travel a small distance past the magazine release notch 174, and then when the force of insertion is removed (i.e., the user stops pushing the magazine 110 into the frame 101), the magazine 110 falls slightly downward until the release notch 174 "catches" the magazine notch 122 thus settling the magazine 110 in place into its seated position. In the systems and methods of the inventive subject matter, the magazine 200 dropping into its seated position causes pivoting slide lock actuator 210 to disengage the pivoting slide lock actuation surface 420S of pivoting slide lock 420, freeing the entire upper firearm assembly (slide assembly 400 and any additional cartridge chambering mechanisms and/or other components that travel with the slide assembly 400) to move (via the force of compressed main spring 103) and chamber a cartridge (FIGS. 30-31; FIG. 30A is a close-up view of section MI in FIG. 30). FIGS. 30-31 also illustrate the resetting of pivoting slide lock 420 to its default, downward position (via the force provided by pivoting slide lock spring 410). Thus, in the default downward position, the pivoting slide lock notch 420T is ready to reengage slide release tip 102T of slide release 102 when magazine 200 is subsequently emptied and the last cartridge 105 fired.

It should be noted the dimensions and tolerances can vary depending on the shapes and sizes of firearm frames 101 and magazines 200, such as from one type or model of firearm to another. Thus, for certain frames 101 and magazines 200, the default travel distance from a fully inserted magazine 200 to that of the magazine 200 at a seated position (where release notch 174 catches magazine notch 220) is sufficient to allow the disengagement of slide lock actuator 210 from pivoting slide lock 420 and for the pivoting slide lock 420 to pivot to its default downward position without interference from the pivoting slide lock actuator 210. In these embodiments, the configuration of magazine notch 220 is therefore unchanged from magazine notch 122. However, in other embodiments, the default tolerance distance between a fully-inserted and a seated magazine 200 may not be sufficient to clear the pivoting slide lock actuator 210 such that the slide assembly 400 can move freely with the pivoting slide lock 420 in its default downward position. In these embodiments, it is contemplated that magazine notch 220 is modified such that it extends higher up the magazine 200 such that the magazine 200 "sits" lower within frame 101, providing sufficient clearance for the slide assembly 400 to move freely without interference from pivoting slide lock actuator 210.

In alternative embodiments, the pivoting slide lock 420 can include a downward projection such that the height of pivoting slide lock actuator 210 is reduced. Thus, in these embodiments, the length of pivoting slide lock actuator 210 of FIGS. 26-31 is effectively divided between the projection of pivoting slide lock 420 and the reduced pivoting slide lock actuator 210. This downward projection of pivoting slide lock is aligned to engage the reduced pivoting slide lock actuator 210 when the magazine 200 is inserted.

In still other alternative embodiments, the entirety of pivoting slide lock actuator 210 can be incorporated into pivoting slide lock 420 as a projection extending downward such that an upper edge of a corresponding side of unmodified magazine 110 contacts the slide lock actuator of pivoting slide lock 420 when magazine 110 is inserted, causing it to pivot and disengage from slide release 102.

Figure 32B:
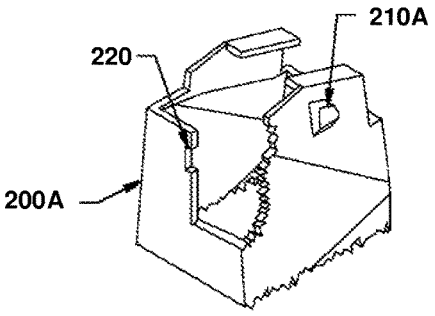
FIGS. 32-32C illustrate an alternative embodiment of the magazine of the inventive subject matter.
Figure 32C:
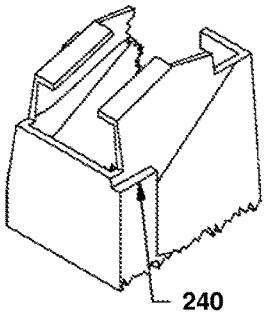

FIGS. 32-32A illustrate an embodiment of the inventive subject matter magazine 200A which includes pivoting slide lock actuator 210A (in the form of a tab or projection) projecting horizontally from a side wall of magazine 200A, rather than the projection from the top of magazine 200 illustrated in FIGS. 23-31. As shown in FIG. 32A (a close-up of section II of FIG. 32), pivoting slide lock actuator 210A is aligned such that when magazine 200A is fully inserted into frame 101, the pivoting slide lock actuator 210A will engage the pivoting slide lock actuation surface 420S of the pivoting slide lock 420, causing pivoting slide lock to rotate upward and disengage from slide release tip 102T of slide release 102 (as described above with regard to the interactions between pivoting slide lock actuator 210 and slide assembly 400, and illustrated for this embodiment in FIG. 33). FIG. 32A also shows magazine follower 223 of magazine 200A and slide chambering notch 401C of slide 401. FIGS. 32B-32C are additional front and rear isometric views of magazine 200A, with FIG. 32C illustrating the magazine insertion limit notch 240 of magazine 200A.

Figure 33:
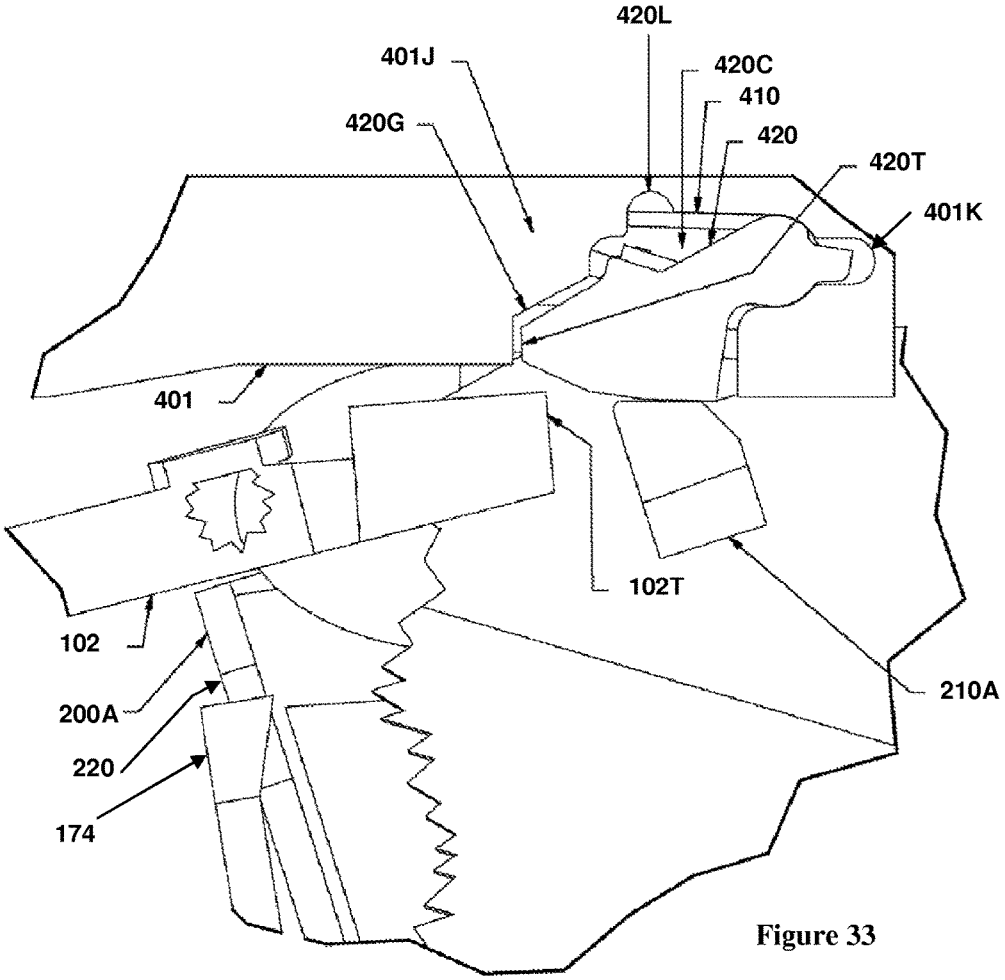
FIG. 33 provides a close-up view of the pivoting slide lock actuated upon by the magazine of FIGS. 32-32C.
Figure 34:
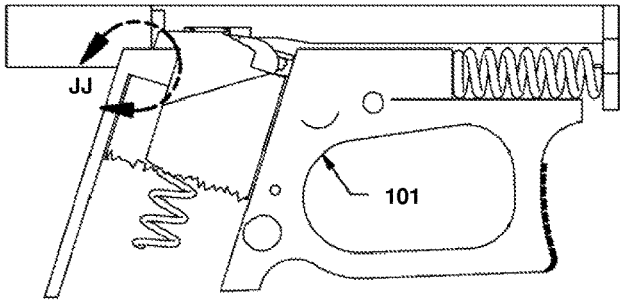
FIGS. 34-34A are views of FIG. 33, from the opposite side of the frame, with the magazine fully inserted.
Figure 37A:
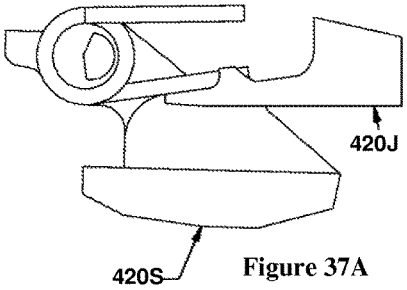
FIGS. 37A-37E provide various isolated views of the pivoting slide lock of the inventive subject matter.
Figure 34A:
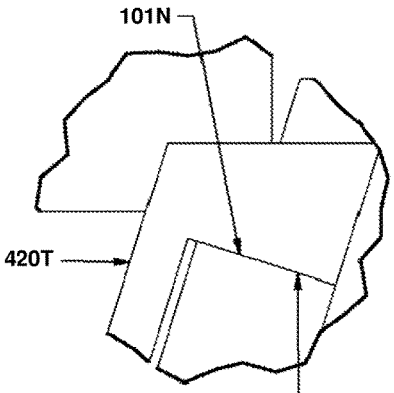

FIG. 34 is a view from the opposite side of the frame 101 having magazine 200A fully inserted as illustrated in FIG. 33. FIG. 34A provides a close-up view of section JJ of FIG. 34, and shows the interaction of frame magazine insertion limit notch 101N of frame 101 and magazine insertion limit notch 240 of magazine 200A that keeps the magazine 200A from being inserted any further into frame 101. In FIG. 34A, the magazine 200A is fully inserted and, as such, there is no gap between notch 101N and notch 240 (i.e., they are in contact). FIG. 33 shows that when a magazine 220A is fully inserted, the magazine release notch 174 of magazine release 170 is not in contact with the magazine notch 220 of magazine 220A.

As shown in FIG. 33, the highest point of pivoting slide lock actuator 210A is below the lowest edge of the side of slide 401. Thus, once the pivoting slide lock 420 is disengaged from the slide release 102, the slide 401 can immediately begin moving forward (via the force exerted by spring 103) without interference from pivoting slide lock actuator 210A, even if the magazine 200A is maintained in the fully-inserted position as shown in FIG. 33 and not allowed to drop to the "seated" position (e.g., held in place by a user, if the firearm 100 is upside-down, etc.).

To facilitate the ability of the slide assembly 400 to move forward even if the magazine 200A is maintained in a fully-inserted position, the pivoting slide lock actuation surface 420S of the embodiment shown in FIG. 33 is a multi-planar surface having one or more of the planes tapering upward toward each end of the pivoting slide lock 420 instead of the uniformly planar surface of actuation surface 420S of FIGS. 20-31. In a variation of this embodiment, the pivoting slide lock actuation surface 420S can be a rounded surface.

FIG. 33 also illustrates a soft-release gap 420G between pivoting slide lock 420 and the surfaces of slide 401 that form cavity 420C. The soft-release gap 420G is created by shaping cavity 420C and pivoting slide lock 420 (including, but not limited to, the shape and dimension of actuation surface 420S) such that when a magazine 200A is stopped from being inserted any further by contact between notches 101N and 240, the actuation of the pivoting slide lock 420 by the pivoting slide actuator 210A is insufficient to cause the pivoting slide lock 420 to rotate into making contact with the surfaces of slide 401 that form the "front" of cavity 420C. This prevents actual contact between this section of pivoting slide lock 420 and the slide 401, reducing wear and tear on the materials caused by repeated magazine loadings over time. Also shown in FIG. 33 is pivoting slide locking and disassembly cavity 420L that enables external user access to the spring 410 for easy insertion and removal of pivoting slide lock 420 (such as for cleaning, maintenance, repair, or replacement).

Figure 35:
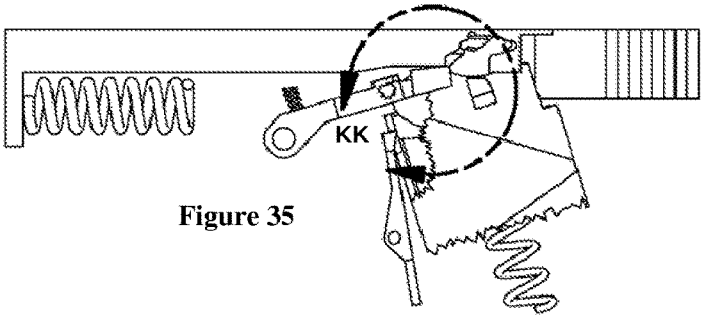
FIGS. 35-35A illustrate the magazine in a seated position within the firearm frame, with the slide in a locked position via slide release engaged with pivoting slide lock.
Figure 35A:
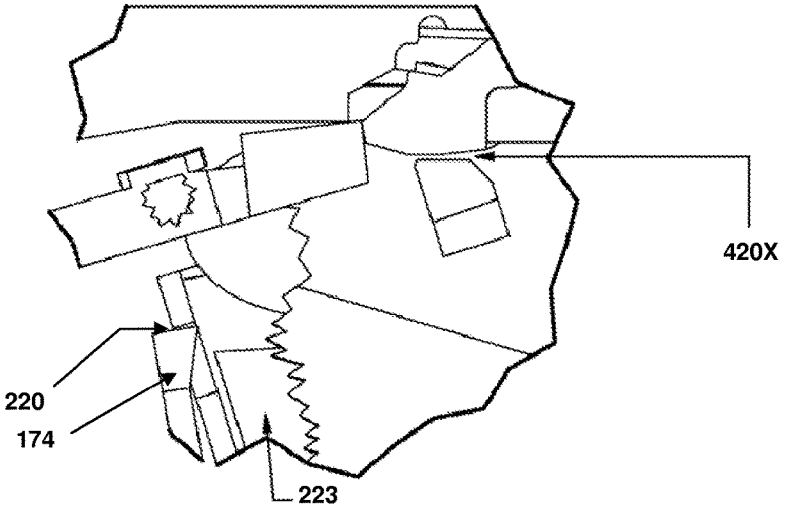
Figure 36:
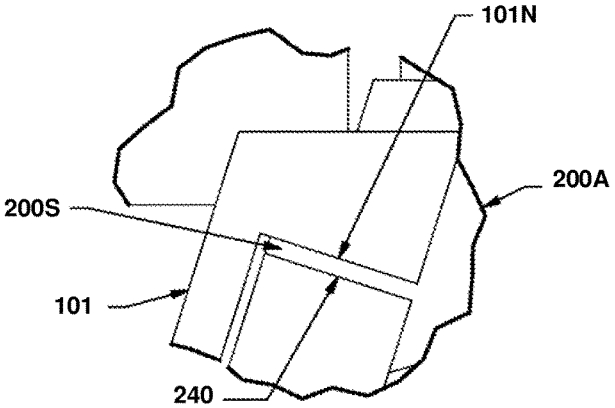
FIG. 36 illustrates a reverse view of the firearm of FIGS. 35-35A.

FIGS. 35-35A illustrate the magazine 200A in a seated position within frame 101, with the slide 401 in a locked position via slide release 102 engaged with pivoting slide lock 420. As seen in FIG. 35A (a close-up of section KK of FIG. 35), when the magazine 200A is in a seated position, it is secured within frame 101 by the engagement of magazine release notch 174 of magazine release 170 in contact with the magazine notch 220 and there is a gap 420X between the pivoting slide lock actuator 210A and the pivoting slide lock 420. Like FIG. 34A, FIG. 36 illustrates a reverse view of the firearm of FIGS. 35-35A and shows gap 200S between notches 101N and 240 that exists when magazine 200A is in the seated position within frame 101. The astute reader will appreciate from FIGS. 35-36 that the inventive subject matter is configured such that the travel of the magazine 200A between fully-inserted and seated positions creates gap 420X (which may be equal to the gap 200S or less than the gap 200S) which enables a user to load the magazine 200A into frame 101 to the fully-inserted position such that the pivoting slide lock 420 is actuated and the slide 401 is released as described herein in a single loading motion. However, if a user wishes slide 401 to remain locked after the insertion of the magazine 200A, this configuration also enables a user to alternatively insert the magazine 200A to a position where magazine release notch 174 engages magazine notch 220 but that the pivoting slide lock actuator 210A does not contact pivoting slide lock 420 (or does contact it, but pivoting slide lock 420 does not pivot sufficiently to disengage the pivoting slide lock 420 from slide release 102). In another alternative, a user that would prefer that slide 401 remain locked can insert magazine 200A into frame 101 until the magazine cannot be inserted further, but without sufficient force to overcome the bias force exerted by spring 410.

Figure 37E:
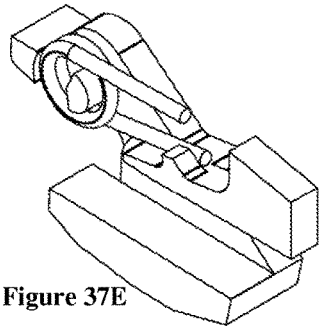
Figure 37B:
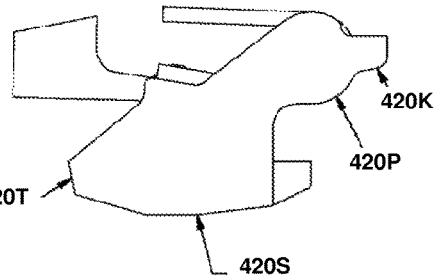
Figure 37C:
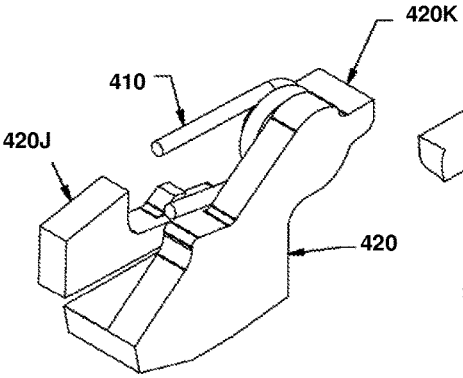
Figure 37D:
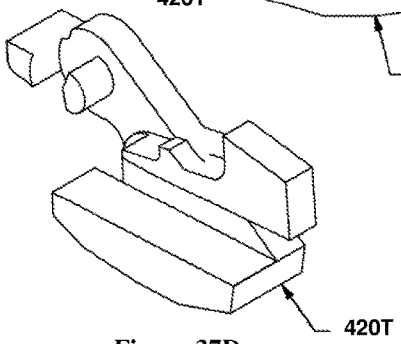

FIGS. 37A-37E provide various isolated views of pivoting slide lock 420. As labeled in FIGS. 37A and 37C, pivoting slide lock 420 can include a pivoting slide lock alignment lobe 420J that fits into a pivoting slide lock alignment lobe cavity 401J of slide 401 (labeled in FIG. 33, not shown) such that the pivoting slide lock 420 is kept in alignment within slide 401 and prevented from moving in the lateral direction relative to the slide 401. As shown in FIGS. 37B and 37C, pivoting slide lock 420 can include anti-nose dive lobe 420K that prevents "nose-diving" of pivoting slide lock 420 due to excessive friction or binding between pivot slide lock notch 420T and slide release tip 102T when slide release 102 is actuated downward by thumb pressure on slide release pressing area 102H.

Figure 38B:
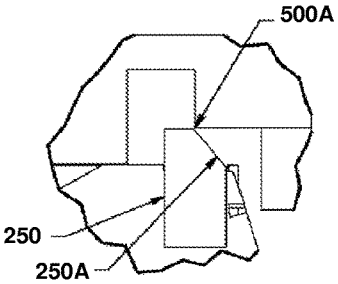
FIGS. 38-39B show an alternative embodiment of an automatic ammunition chambering system of the inventive subject matter.
Figure 38A:
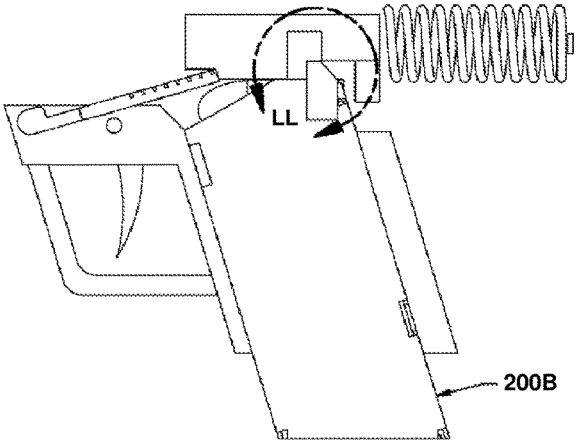
Figure 39:
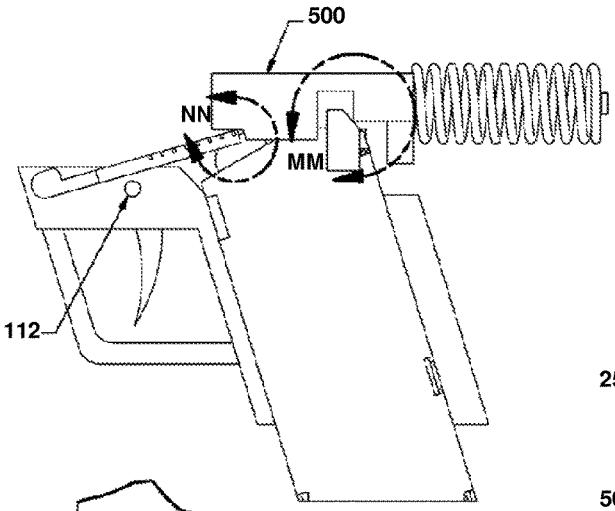
Figure 39A:
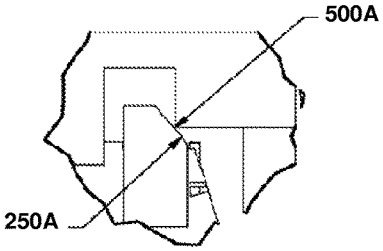
Figure 39B:
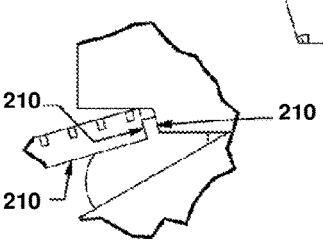
Figure 38:
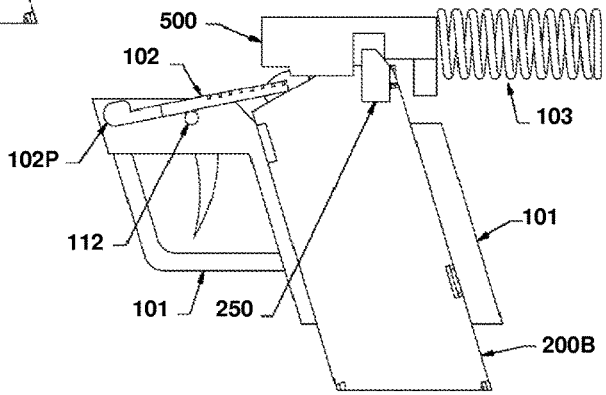
Figure 40:
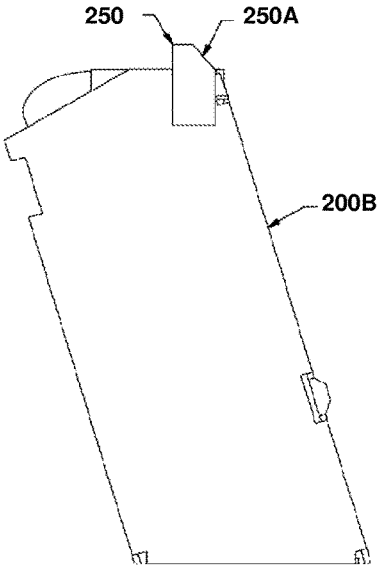
FIGS. 40-43 provide various isolated views of the magazine of the embodiment of FIGS. 38-39B.
Figure 41:
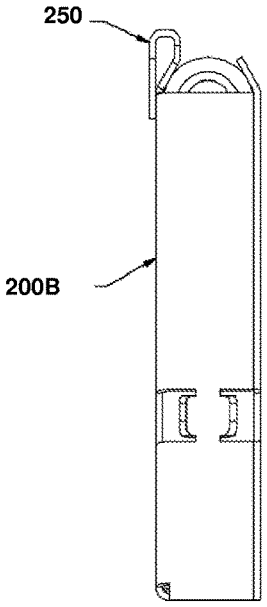
Figure 42:
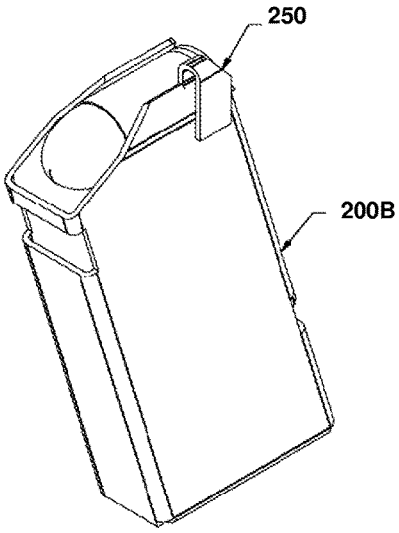
Figure 43:
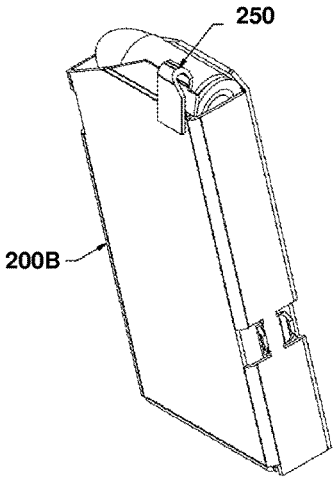

FIGS. 38-39B show an alternative embodiment of an automatic ammunition chambering system of the inventive subject matter. FIG. 38 illustrates the components of this embodiment. In this embodiment, magazine 200B includes a slide moving tab 250 having a slide displacement surface 250A and slide 500 which includes a slide corner 500A. FIGS. 38A and 38B (a close-up view of section LL of FIG. 38A) illustrate the firearm with slide 500 in a locked position (engaged with slide release 102) with slide displacement surface 250A about to contact slide corner 500A of slide 500. As magazine 200B is inserted into frame 101, slide displacement surface 250A comes into contact with slide corner 500A. As magazine 200B continues to be inserted upward into frame 101, the contact between slide displacement surface 250A and slide corner 500A displaces slide 500 to the right (towards the rear of the firearm) as shown in FIGS. 39-39B. This displacement of slide 500 frees slide release 102 to drop (FIG. 39B, a close-up of section NN of FIG. 39) and rest against slide release rest 112 (as shown in FIG. 38), which in turn allows the upper assembly (slide 500 and any other associated components) to move forward (to the left in the figures) and chamber a cartridge as the upward force to insert magazine 200B is removed and magazine 200B drops slightly to its seated position (not shown).

FIGS. 40-43 provide various isolated views of magazine 200B, including slide moving tab 250. Whereas other embodiments of the inventive subject matter caused pivoting slide lock notch 420T to pivot away from slide release tip 102T, this embodiment simply moves/displaces the entire slide 500 away from slide release tip 102T via the slide displacement surface 250A in the form of an angled tab incorporated into slide moving tab 250, which pushes against slide corner 500A. In embodiments, the slide moving tab 250 can be configured such that it aligns and pushes against any convenient corner or protrusion already existent in slide 104.

Figure 44:
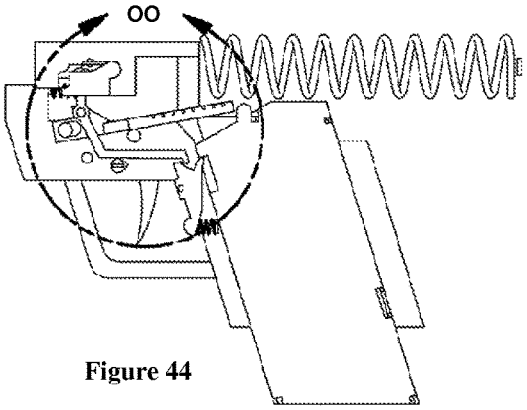
FIGS. 44-45A show various side and exploded views of an embodiment of a magazine auto-eject assembly of the inventive subject matter.
Figure 44A:
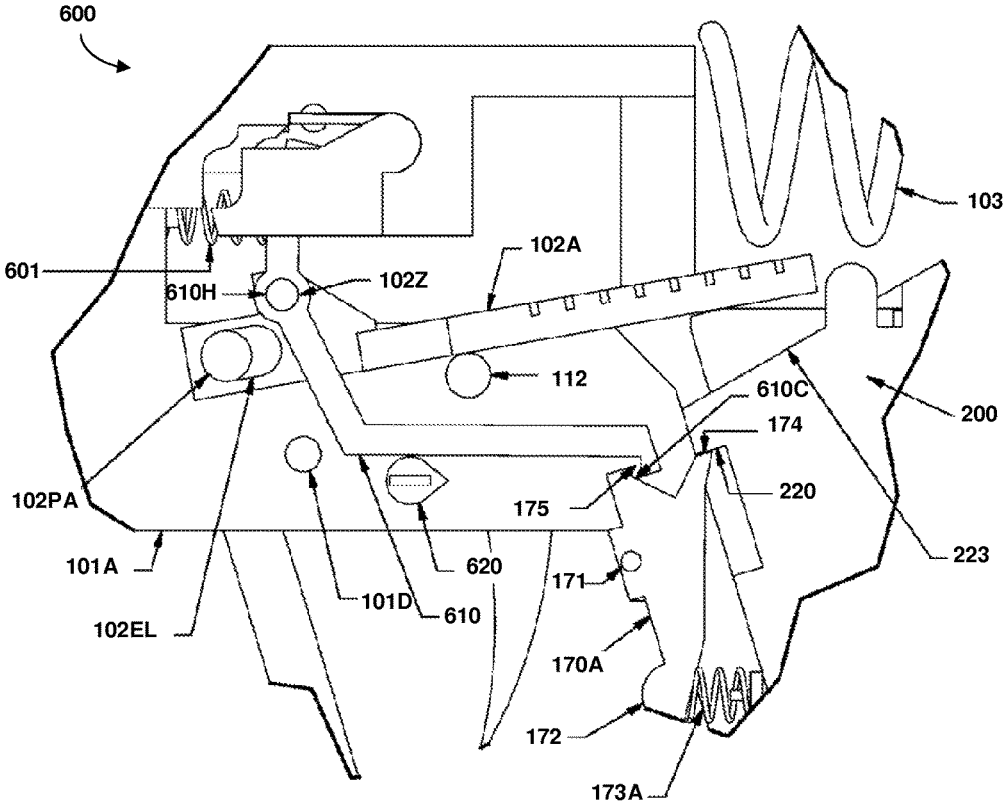
Figure 45:
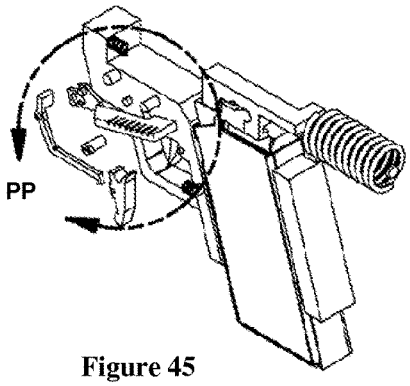
Figure 45A:
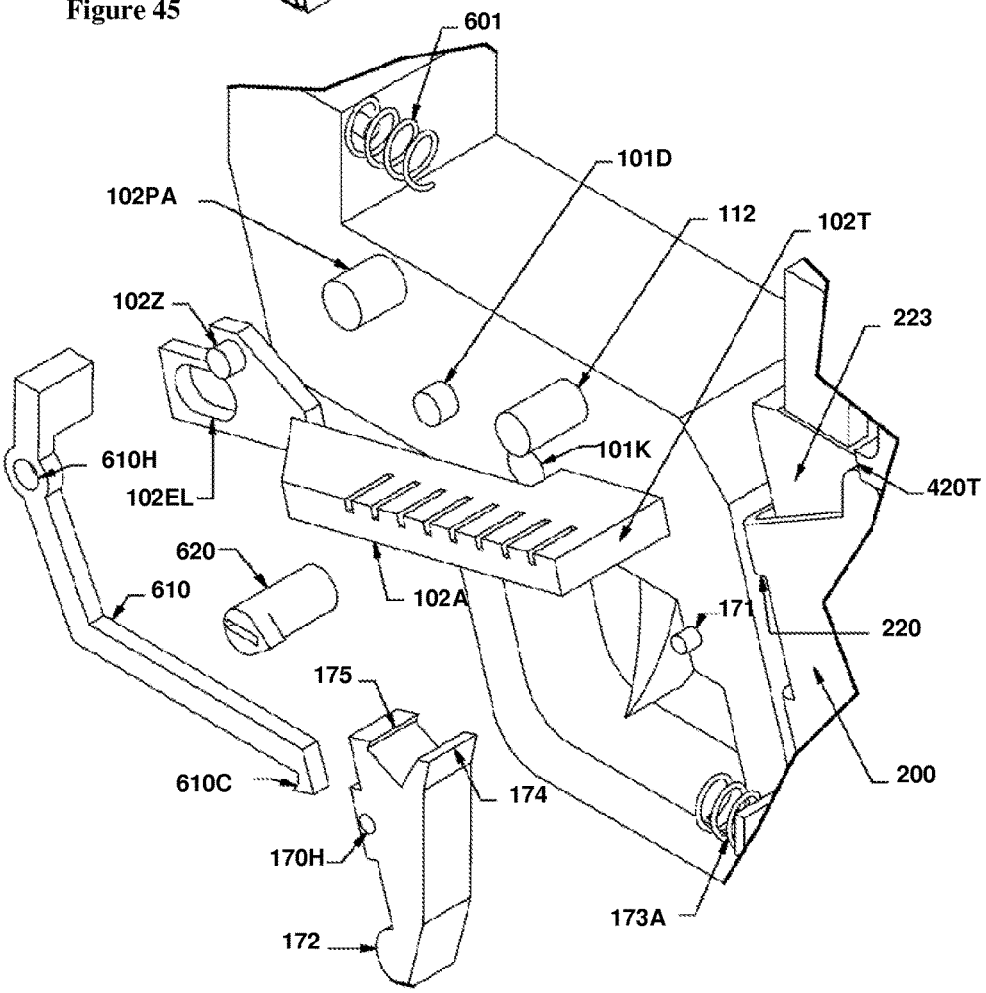

FIGS. 44-45A show various side and exploded views of an embodiment of a magazine auto-eject assembly 600 of the inventive subject matter. As shown in FIG. 44A (close-up view of section OO of FIG. 44) and FIG. 45A (close-up view of section PP of FIG. 45), assembly 600 comprises an actuator spring 601, frame 101A, a magazine release actuator 610, a slide release 102A, a magazine release 170A, and a magazine release spring 173A. In FIG. 44A, the firearm is shown as being in an unlocked, ready to fire state.

Frame 101A further comprises a slide release pivot 102PA, a magazine release pivot 171, a disable knob hole 101K (in embodiments described in further detail below), a slide release rest 112, and a magazine release actuator catch disengager 101D (shown as a projecting tab with a rounded cross-section).

Magazine release actuator 610 further comprises a slide release coupling in the form of an actuator pivot hole 610H, and an actuator catch 610C.

Slide release 102A comprises a slide release tip 102T, an actuator coupling in the form of a magazine release actuator pivot 102Z, and an elongated slide release pivot hole 102EL.

The elongated hole 102EL is dimensioned to allow the rotation and translation of the slide release pivot 102PA within the hole 102EL.

Magazine release 170A further comprises a magazine release pivot hole 170H, a magazine release button 172, a magazine release catch 175, and a magazine release notch 174.

FIGS. 46-50A show the various operational states of the magazine auto-eject assembly 600 of an out-of-ammunition weapon, actuated by the returning pivoting slide lock notch 420T (which is in turn powered by main spring 103). In the illustrated example, the actuator catch 610C is illustrated as a hook-shaped catch (but can be of any suitable shape capable of engaging and disengaging with the magazine release catch 175 in accordance with the functions and methods of the inventive subject matter described herein) and magazine release catch 175 illustrated as a hook-shaped catch, whereby the engagement of the actuator catch 610C and the magazine release catch 175 is caused by the engagement of the two hook-shaped catches upon each other. In the illustrated example, magazine catch 175 is shown having a hook-shaped configuration, but it is contemplated that magazine release catch 175 can be of any suitable shape capable of engaging and disengaging with the actuator catch 610C in accordance with the functions and methods of the inventive subject matter described herein.

Figure 46:
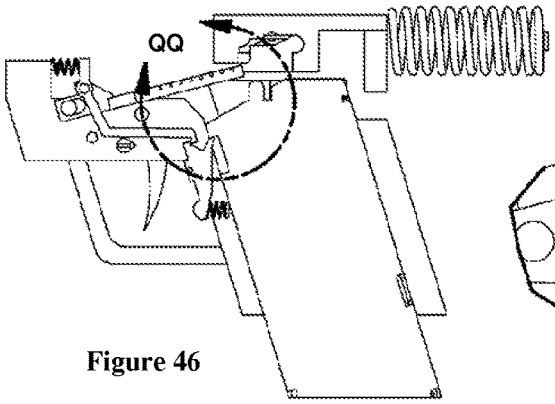
FIGS. 46-46A show the auto-eject system of the inventive subject matter, at the instant that pivoting slide lock notch contacts slide release.
Figure 46A:
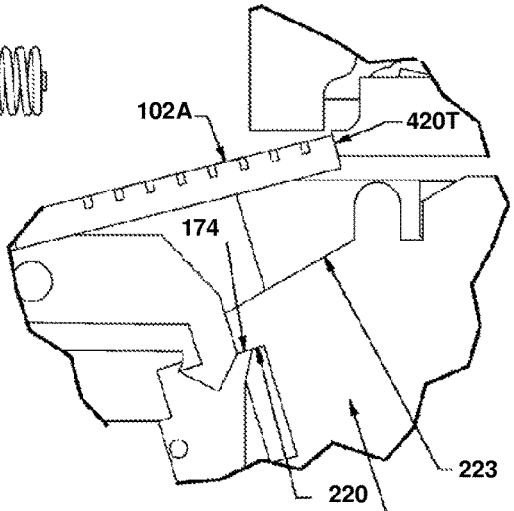

FIGS. 46-46A (close-up view of section QQ of FIG. 46) show slide release 102A pivoted up (counterclockwise) about slide release pivot 102PA, caused by contact of the magazine follower 223 (under the force of spring 111) of empty magazine 200 with the slide release 102A (e.g., via magazine follower activation ledge 102L). The depictions of FIGS. 46-46A are a snapshot of the instant that pivoting slide lock notch 420T contacts slide release 102A, before the returning slide assembly 400 (being acted upon by main spring 103) has begun exerting lateral force on slide release 102A in the direction toward the front of the firearm (from right to left in the Figures).

Figure 47:
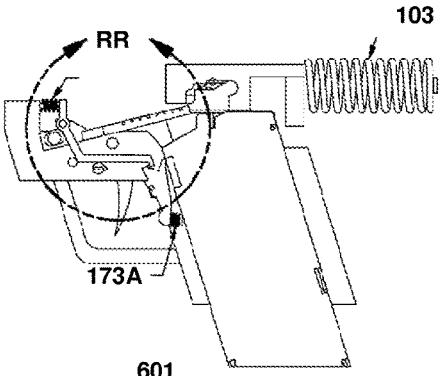
FIGS. 47-47A show the slide release traveling along the elongated hole.
Figure 47A:
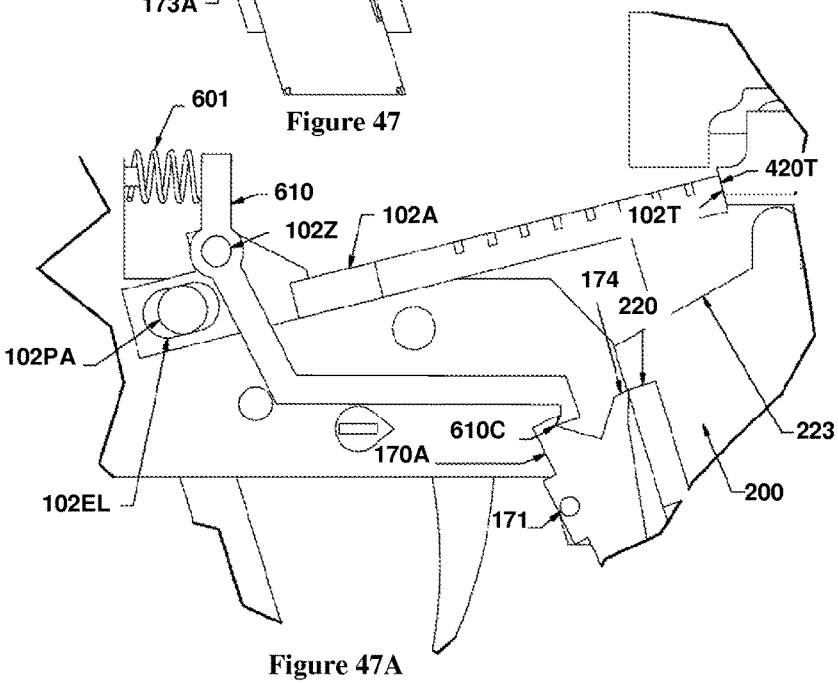

In FIGS. 47-47A (close-up view of section RR of FIG. 47), the force exerted by pivoting slide lock notch 420T (provided by the main spring 103 actuating the slide assembly 400) on slide release tip 102T pushes slide release 102A such that slide release 102A travels along its elongated hole 102EL (as shown by the open spaces on both sides of slide release pivot 102PA within elongated hole 102EL) due to main spring 103 overpowering actuator spring 601 and magazine release spring 173A. As slide release 102A travels along the length of elongated hole 102EL, magazine release actuator 610 is pulled by the slide release 102A (via the magazine release actuator pivot 102Z in actuator pivot hole 610H) and rotates magazine release 170A (counterclockwise) about magazine release pivot 171 (via interaction between magazine release actuator catch 610C and magazine release catch 175). This rotation of magazine release 170A begins to disengage magazine release notch 174 from magazine notch 220.

Figure 48:
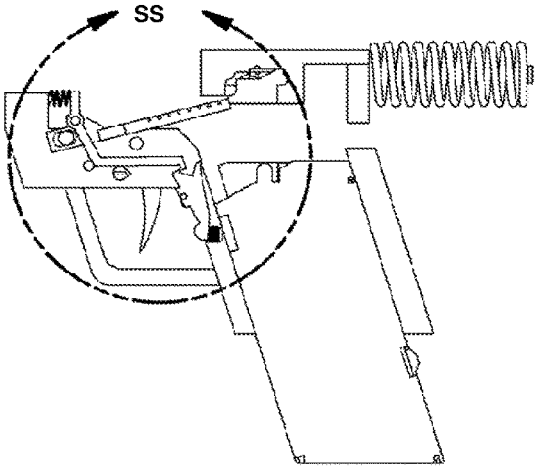
FIGS. 48-48B show slide release driven further by pivoting slide lock, whereby the magazine release notch disengages from the magazine notch.
Figure 48B:
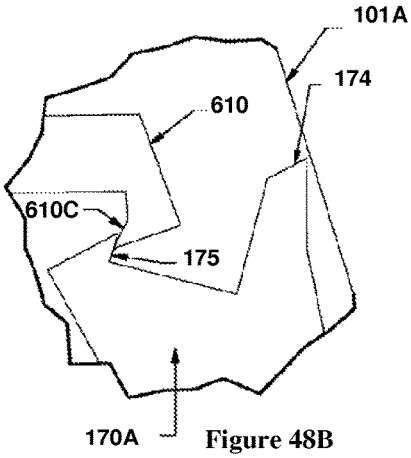
Figure 48A:
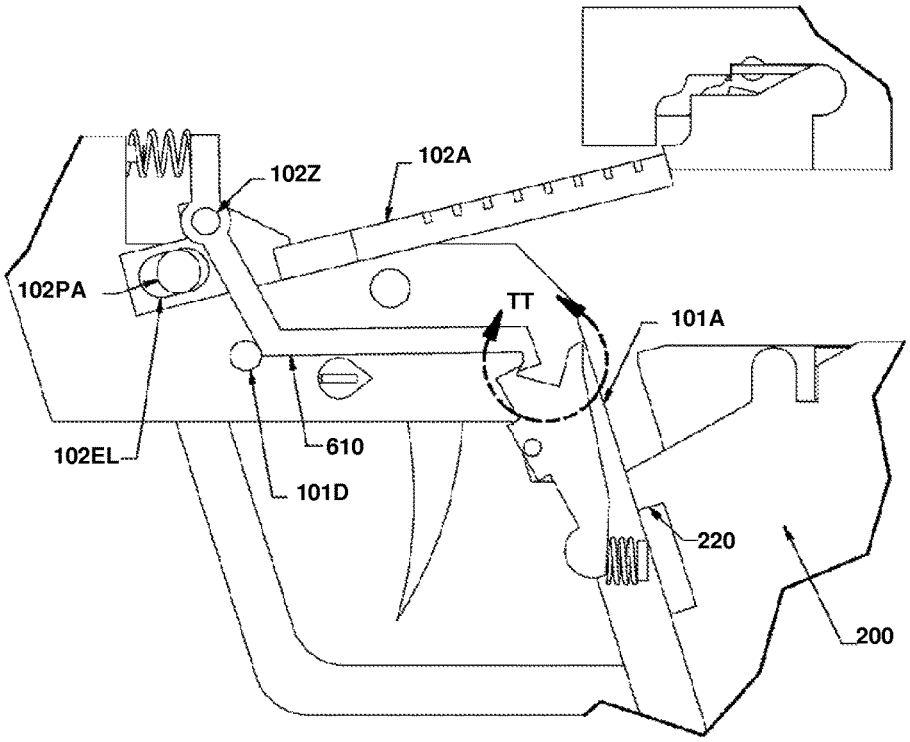

FIGS. 48-48B show slide release 102A driven further by pivoting slide lock 420 and subsequently causing, via the actuation of slide release 102A on release actuator 610 which in turn further rotates magazine release 170A counterclockwise, magazine release notch 174 to disengage from magazine notch 220. With magazine release notch 174 disengaged from magazine notch 220, there is no mechanism securing magazine 200 within frame 101A and as such, magazine 200 is ejected from frame 101A as shown in FIG. 48A (close-up of section SS of FIG. 48) due to the force of gravity. FIGS. 48A and 48B (close-up of section TT of FIG. 48A) also show the beginning of disengagement between magazine release actuator catch 610C and magazine release catch 175 due to the elbow of magazine release actuator 610 contacting magazine release actuator catch disengager 101D and thus causing magazine release actuator 610 to begin counterclockwise rotation about magazine release actuator pivot 102Z.

Figure 49:
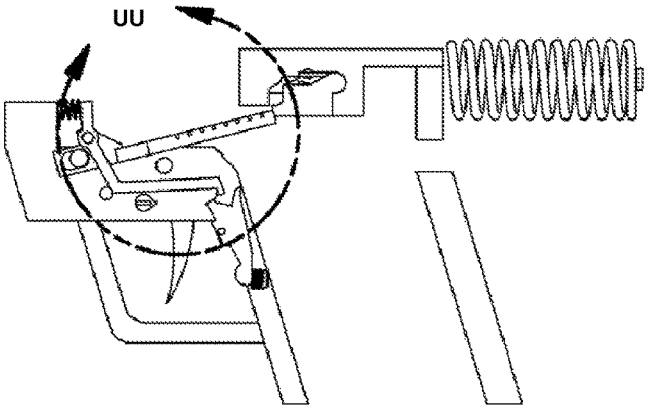
FIGS. 49-49A show the state of the auto-eject system at a full disengagement of the magazine release actuator catch from the magazine release catch.
Figure 49A:
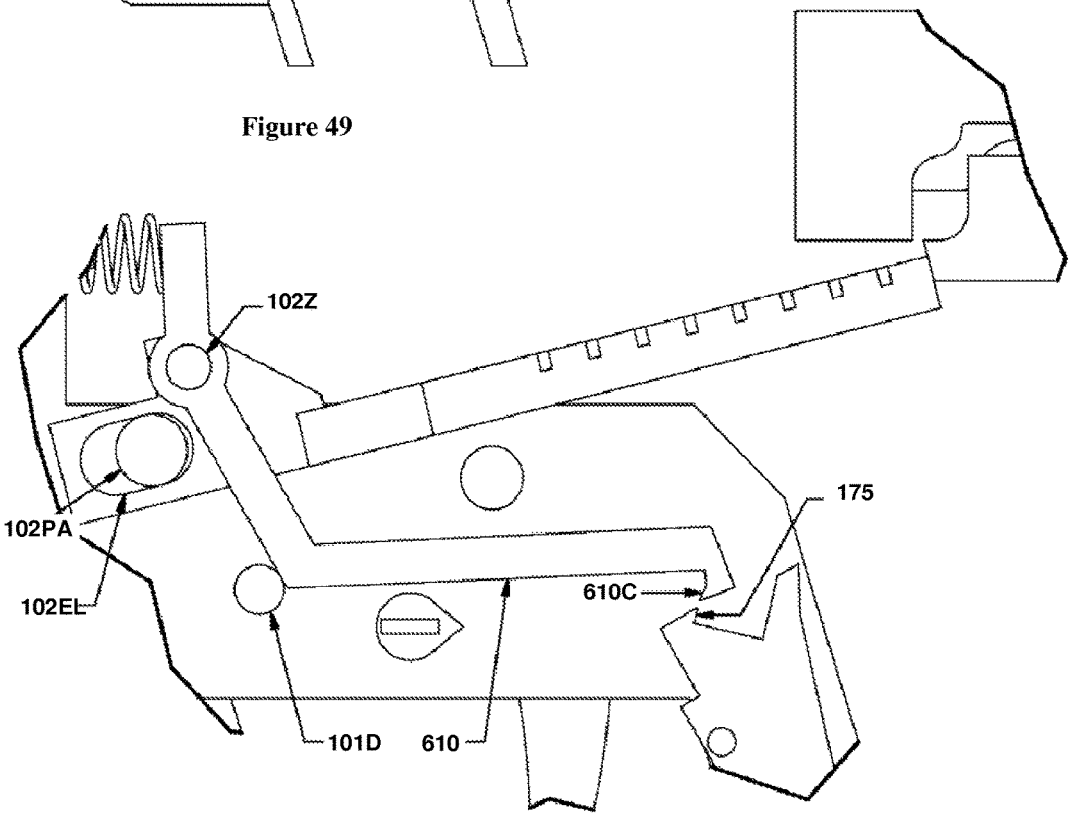

FIGS. 49-49A show slide release 102A continuing to be driven further and the resulting continual rotation of magazine release actuator 610 about its magazine release actuator pivot 102Z, resulting in subsequent full disengagement of magazine release actuator catch 610C from magazine release catch 175. Thus, it can be appreciated the elongated hole 102EL is dimensioned such that the distance of travel of the slide release 102A is sufficient to cause the disengagement of release notch 174 from magazine notch 220 (i.e., cause sufficient rotation of the magazine release 170A about pivot 171 to cause the disengagement).

Figure 50:
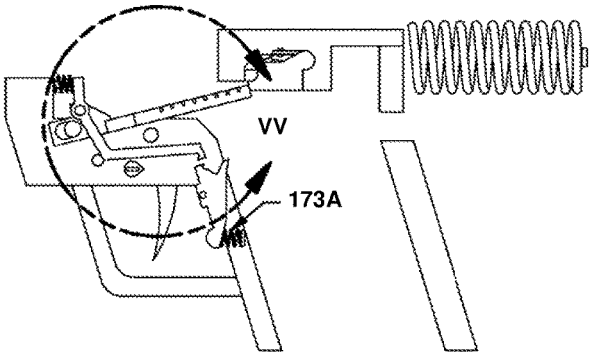
FIGS. 50-50A illustrate the state of the auto-eject system at the end of the automatic magazine ejection process.
Figure 50A:
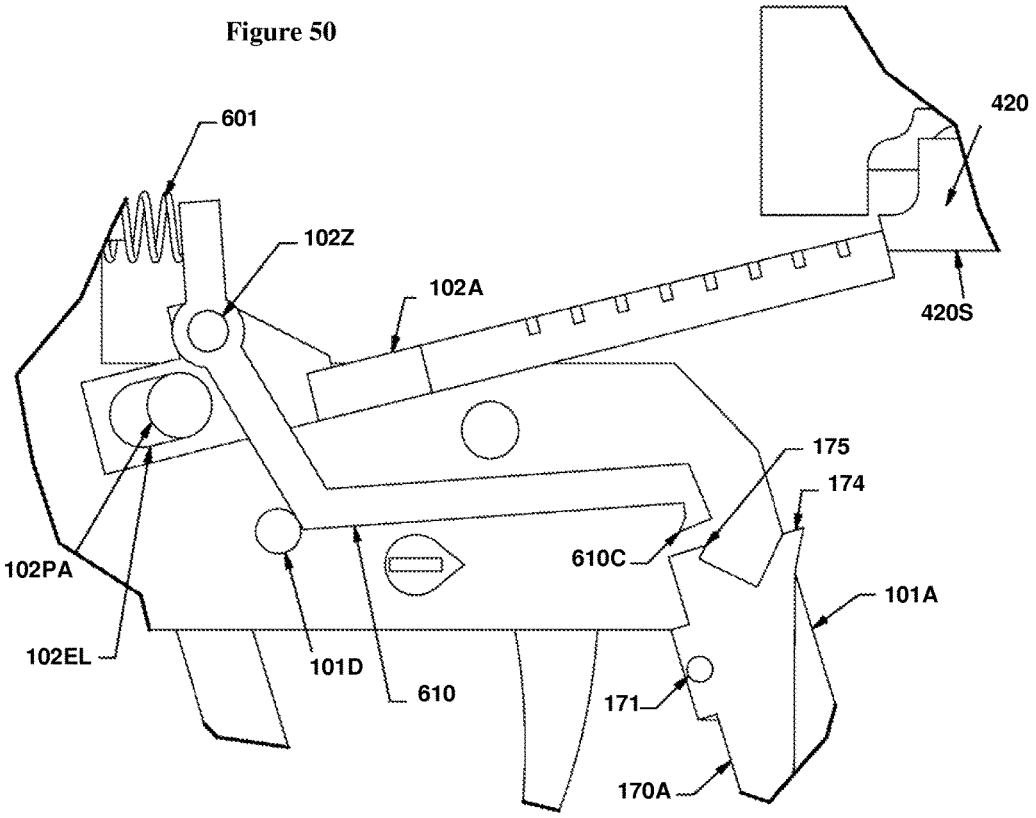

FIGS. 50-50A illustrate the end of the automatic magazine ejection process, showing the end state of assembly 600 with slide release 102A displaced the complete length of elongated hole 102EL and magazine release actuator catch 610C fully disengaged from magazine release catch 175 (after having actuated magazine release 170A to eject the magazine 200). Magazine release 170A is reset to its ready-to-engage-magazine state via the biasing force of magazine release spring 173A (with magazine release notch 174 back to its default position extending outwardly from frame 101A, ready to engage with the magazine notch 220 of a new magazine 200). Thus, as shown, a new magazine 200 can be inserted such that it will be engaged by the magazine release notch 174 and held in place within frame 101A even if the slide release 102A is not disengaged from pivoting slide lock 420 (or a conventional slide 104 if assembly 600 is used in a weapon that does not have the automatic ammunition chambering system equipped). In the illustrated embodiment, slide assembly 400 is now ready to automatically chamber a cartridge 105 from a loaded magazine 200 via its pivoting slide lock actuator 210 interacting (pushing up and rotating) with pivoting slide lock actuation surface 420S of pivoting slide lock 420 as previously described.

When the slide release 102A is disengaged from the pivoting slide lock 420 (e.g., due to the actuation of the pivoting slide lock 420 by the pivoting slide lock actuator 210 of a new magazine or via manual release of the slide release 102A by a user's thumb), the slide release 102A (and consequently, the magazine release actuator 610 and actuator spring 601) will no longer be subject to the force exerted by main spring 103. Thus, upon disengagement of slide release 102A from pivoting slide lock 420, the spring 601 (currently compressed), will exert force on magazine release actuator 610 which in turn actuates the slide release 102A. The actuation of spring 601 in combination will cause a clockwise rotation as well as a movement to the right (towards the rear of the firearm) of release actuator 610. This in turn will cause slide release 102A to travel to the right (towards the rear of the firearm) along the elongated hole 102EL as well as provide a biasing force that pivots the slide release 102A downward to rest on slide release rest 112. The clockwise rotation and travel of release actuator 610 will cause the re-engagement of release actuator catch 610C with magazine release catch 175 and return the auto-eject assembly 600 to the state of FIG. 44A (with or without a new magazine 200 having been inserted into frame 101A).

Figure 51:
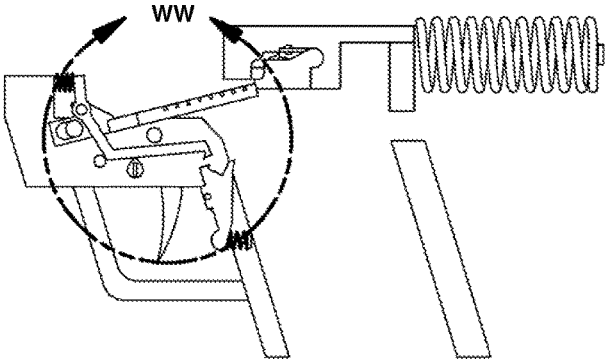
FIGS. 51-51A show auto-eject assembly in a disabled state.
Figure 51A:
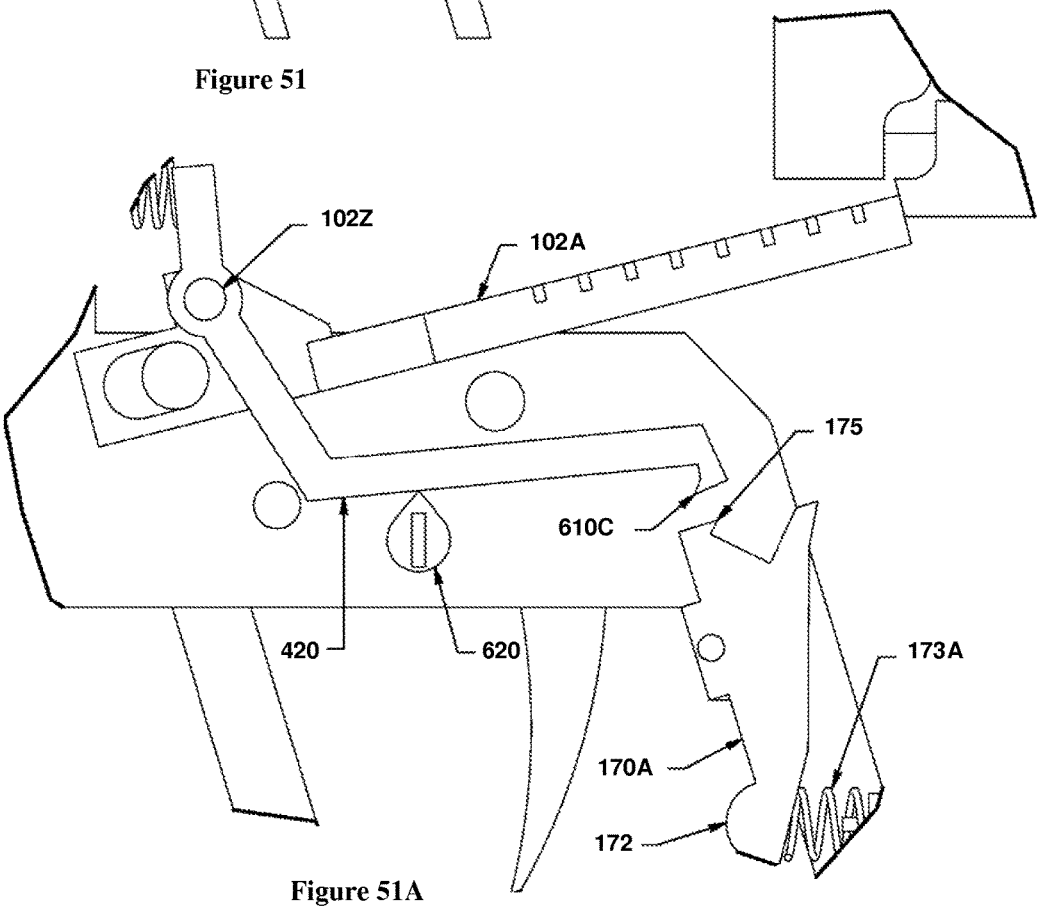

In certain situations, it may not be desirable to a user that an empty magazine be automatically ejected. Thus, in embodiments, the magazine auto-eject assembly 600 can be disabled such that a manual actuation of button 172 is required to eject an empty magazine. In these embodiments, auto-eject assembly 600 can include magazine auto-eject disable knob 620 rotatably disposed within disable knob hole 101K in frame 101A. FIGS. 51-51A show auto-eject assembly 600 in its disabled state. To disable the system 600, disable knob 620 is rotated (such that its pointy end points upward) within the disable knob hole 101K. This rotation causes the disable knob 620 to lift and rotate magazine release actuator 610 sufficiently about magazine release actuator pivot 102Z to completely disengage magazine release actuator catch 610C from magazine release catch 175 (regardless of the current position of slide release 102A). With the assembly 600 disabled, the magazine release 170A is made completely independent of the rest of the system, and magazine release 170A must be actuated via button 172 to release the magazine as would be performed in prior art magazine release systems.

It should be noted that the auto-eject assembly 600 is illustrated on a firearm that also includes the automatic ammunition chambering system (slide assembly 400 and magazine 200) of embodiments of the inventive subject matter illustrated in FIGS. 20-31. This combination of the automatic ammunition chambering system and the auto-eject assembly 600 enables a user to reload an out-of-ammunition state firearm with a single user-required action: the introduction of a new magazine 200 into frame 101A. The steps of ejecting the empty magazine and releasing the slide to chamber a round are performed automatically by the systems of the inventive subject matter. However, just like the automatic ammunition chambering system is illustrated without the auto-eject assembly in FIGS. 20-31, it is similarly contemplated that the auto-eject assembly 600 can be incorporated into a firearm without the automatic ammunition chambering system components.

Figure 52:
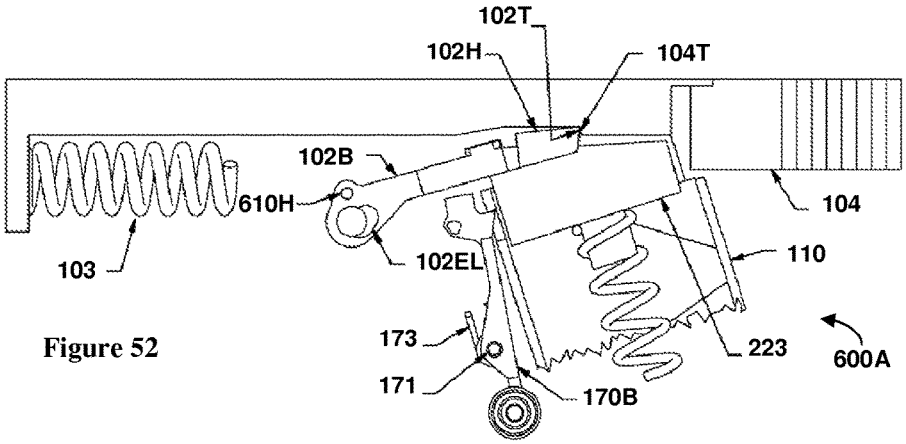
FIGS. 52-54 illustrate the various components of auto-eject assembly, according to an embodiment of the inventive subject matter.
Figure 53:
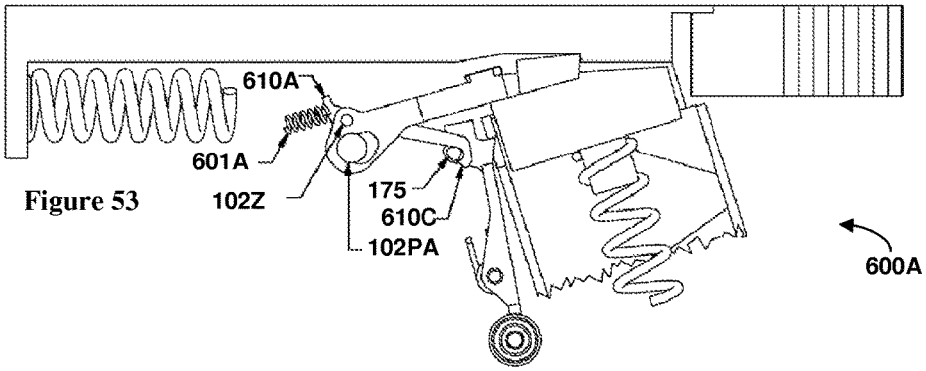
Figure 54:
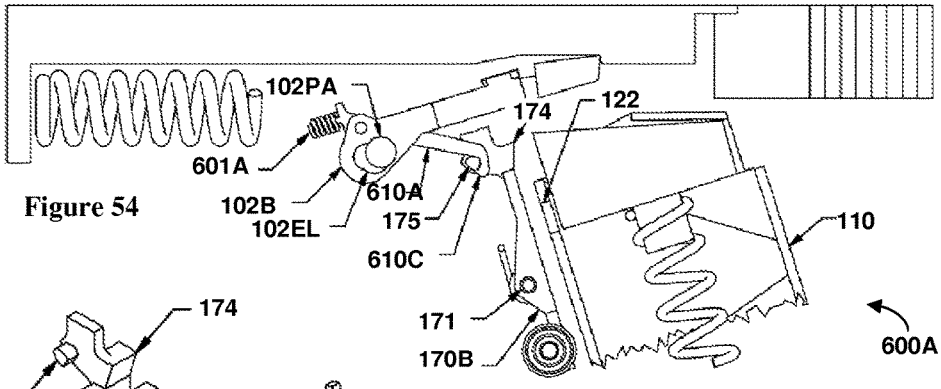

Alternate embodiments of an auto-eject assembly of the inventive subject matter is shown in FIGS. 52-69. FIGS. 52-54 illustrate the various components of auto-eject assembly 600A. Auto eject assembly 600A includes frame 101B, slide release 102B, magazine release 170B, magazine release spring 173, magazine release actuator 610A, actuator spring 601A, and in certain embodiments, magazine auto-eject system disable knob 620A.

Frame 101B includes slide release pivot 102PA, a disable knob hole 101K configured to fit disable knob 620A, and magazine release pivot 171.

Figure 66:
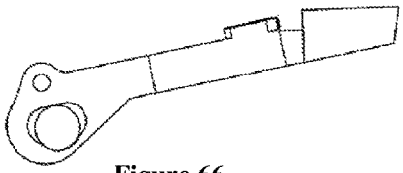
FIG. 66 illustrates the installation of the slide release onto slide release pivot.
Figure 67:
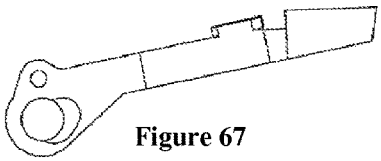
FIGS. 67 and 69 provide views of the slide release traveling via the elongated hole fitting on the pivot locking groove.
Figure 68:
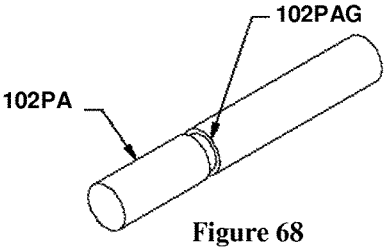
FIG. 68 provides an isolated view of slide release pivot.
Figure 69:
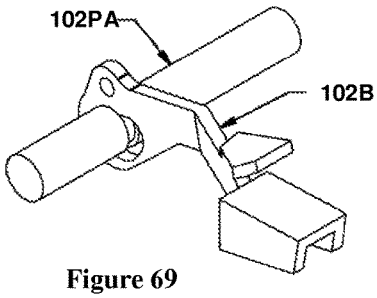

Slide release 102B includes the features of prior art slide release 102, and further includes an actuator coupling in the form of a magazine release actuator pivot hole 610H, and elongated hole 102EL. As shown in FIGS. 52-69, the elongated hole 102EL is approximately triangularly-shaped. FIG. 66 illustrates the installation of slide release 102B onto slide release pivot 102PA by fitting slide release pivot 102PA through the central section of the hole 102EL where the width of the hole 102EL accommodates the full diameter of slide release pivot 102PA. Once installed, the slide release 102B sits and operates within slide release pivot locking groove 102PAG. FIGS. 67 and 69 provide views of the slide release 102B traveling via the elongated hole 102EL fitting on the pivot locking groove 102PAG. FIG. 68 provides an isolated view of slide release pivot 102PA.

Figure 53A:
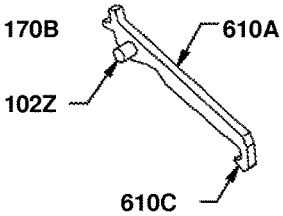

In these embodiments, magazine release actuator 610A includes a slide release coupling in the form of a magazine release actuator pivot 102Z, and actuator catch 610C (illustrated herein as a hook-shaped catch, but can be of any suitable shape capable of engaging and disengaging with the magazine release catch 175 in accordance with the functions and methods of the inventive subject matter described herein). FIG. 53A provides an isolated view of magazine release actuator 610A.

Figure 52A:
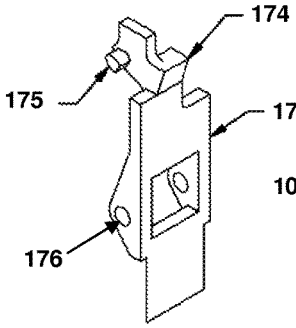

As with prior art magazine release 170 of FIG. 8, magazine release 170B (illustrated in isolation in FIG. 52A) includes a magazine release pivot hole 176, through which magazine release pivot 171 fits to pivotably connect the magazine release 170B to frame 101B, magazine release spring 173 and magazine release notch 174. Magazine release 170B of the inventive subject matter further includes an extension behind magazine release notch 174 as shown in FIG. 52A from which magazine release catch 175 projects outward, shaped to be engaged by the actuator catch 610C of magazine release actuator 610A. In the illustrated example, magazine catch 175 is shown as an outwardly projecting tab, but it is contemplated that magazine release catch 175 can be of any suitable shape capable of engaging and disengaging with the actuator catch 610C in accordance with the functions and methods of the inventive subject matter described herein.

FIG. 52 shows the placement of certain components of assembly 600A according to these embodiments. In FIG. 52, the magazine release actuator 610A and actuator spring 601A are omitted to show other components with greater clarity. Additionally, FIGS. 52-58 illustrate various aspects of the assembly 600A of the inventive subject matter with a weapon that has a conventional slide 104. FIGS. 59-65 illustrate various aspects of assembly 600A of the inventive subject matter in combination with slide assembly 400 of the automatic ammunition chambering system of the inventive subject matter.

FIG. 53 provides an illustration of the assembly 600A at the moment that slide 104 contacts slide release 102B. At this point, the slide 104 (under the force of main spring 103) has not yet begun to exert force on the slide release 102B in the forward direction (leftward direction in the Figure) and the magazine release 170B is still holding magazine 110 in place.

Figure 55A:
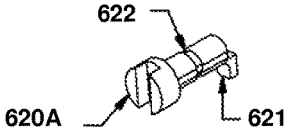
FIG. 55A provides an isometric view of the magazine auto-eject disable knob.
Figure 55:
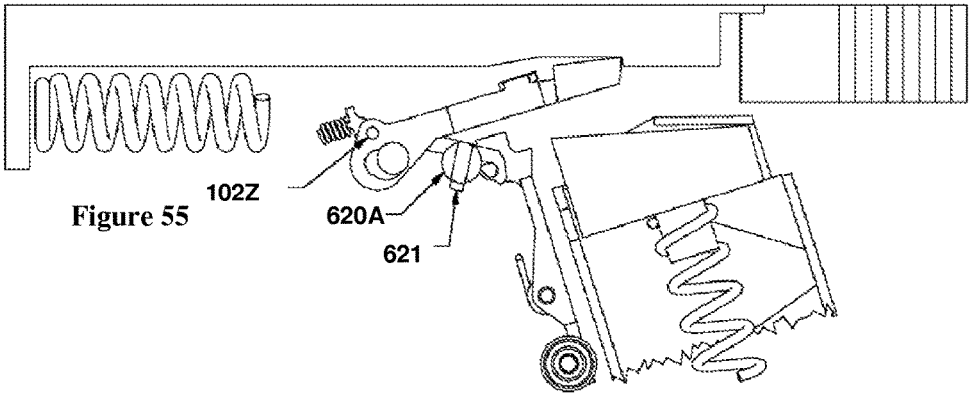
FIG. 55 is the assembly at the state illustrated in FIG. 54, with the addition of the magazine auto-eject disable knob.

FIG. 54 illustrates the assembly 600A after the slide 104 has exerted sufficient force (via main spring 103) to overcome actuator spring 601A and 173, causing slide release 102B to travel the length of elongated hole 102EL. Moving slide release 102B actuates magazine release actuator 610A via the slide release pivot 102PA, causing the magazine release actuator 610A to move in the forward direction of the firearm. As the magazine release actuator 610A is coupled to the magazine release 170B via the interfacing of magazine release actuator catch 610C and magazine release catch 175, the movement of magazine release actuator 610A causes magazine release 170B to pivot counterclockwise about magazine release pivot 171. This rotation of magazine release 170B pulls magazine release notch 174 from engagement with magazine notch 122, causing the release of magazine 110. Thus, it can be appreciated the elongated hole 102EL is dimensioned such that the distance of travel of the slide release 102A is sufficient to cause the disengagement of release notch 174 from magazine notch 122 (i.e., cause sufficient rotation of the magazine release 170A about pivot 171 to cause the disengagement). FIG. 55 is the assembly 600A at the state illustrated in FIG. 54, with the addition of the disable knob 620A. In FIG. 55, the disable knob 620A has not been actuated and as such, the auto-eject assembly 600A is enabled.

Figure 56:
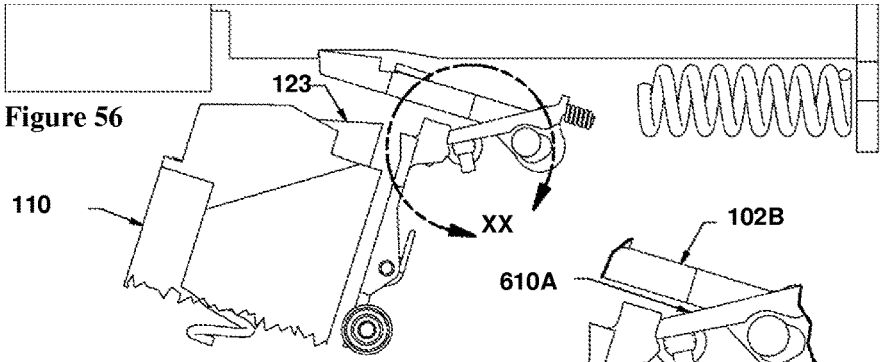
FIGS. 56-56A provide a view of FIG. 55 from the opposite side of the firearm.
Figure 56A:
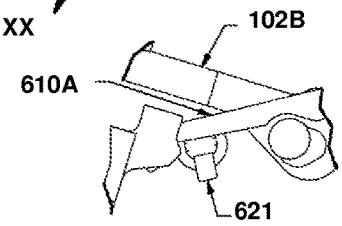

FIGS. 56-56A provide a view of FIG. 55 from the opposite side of the firearm. Thus, in this state where the assembly 600A is enabled, FIG. 56A (close-up of section XX of FIG. 56) shows the disable knob 620A with knob cam lobe 621 in a downward direction, not in contact with magazine release actuator 610A. FIG. 55A provides an isolated view of disable knob 620A, which includes the knob cam lobe 621 and frame locking groove 622 used to secure the knob 620A in frame 101B.

Figure 57:
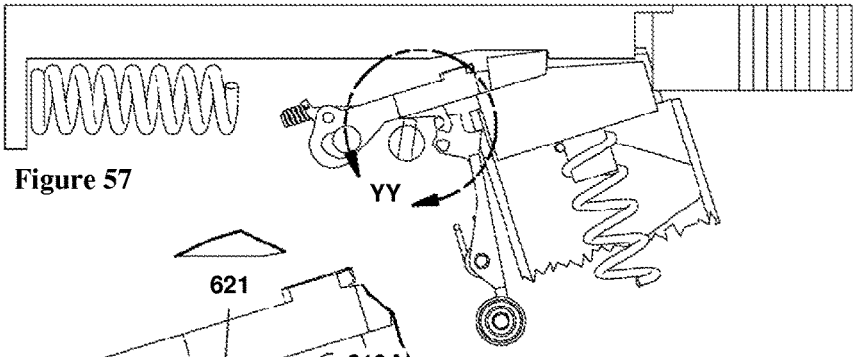
FIGS. 57-58 illustrate the auto-eject assembly of embodiments of the inventive subject matter in a disabled state.
Figure 57A:
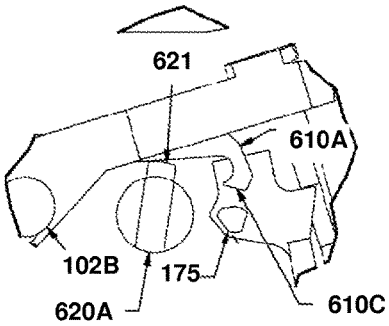
Figure 58:
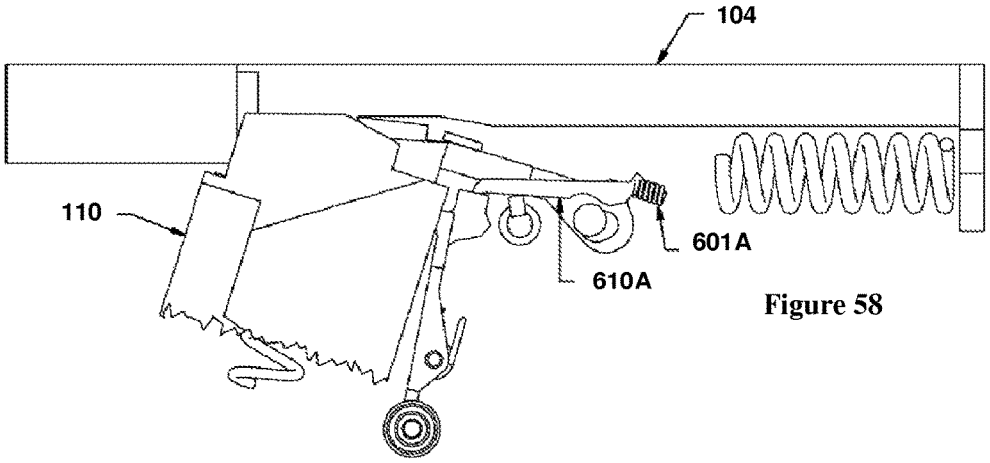

FIGS. 57-58 illustrate the assembly 600A in a disabled state. Similar to the disable knob 620 of FIGS. 51-51A, disable knob 620A disables assembly 600A by causing knob cam lobe 621 to push magazine release actuator 610A upward such that magazine release actuator catch 610C is disengaged from the magazine release catch 175 of magazine release 170B.

Figure 59:
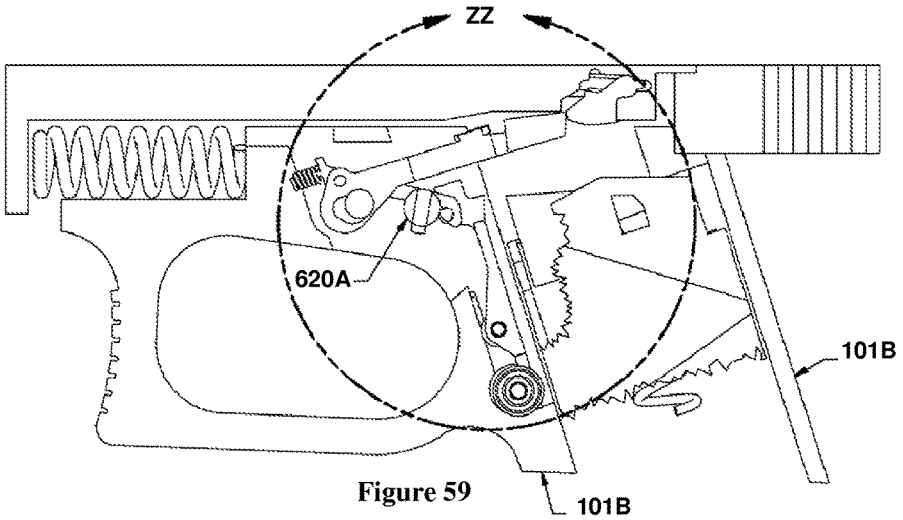
FIG. 59 illustrates a firearm incorporating both slide assembly and auto-eject assembly of embodiments of the inventive subject matter into a single firearm.
Figure 59A:
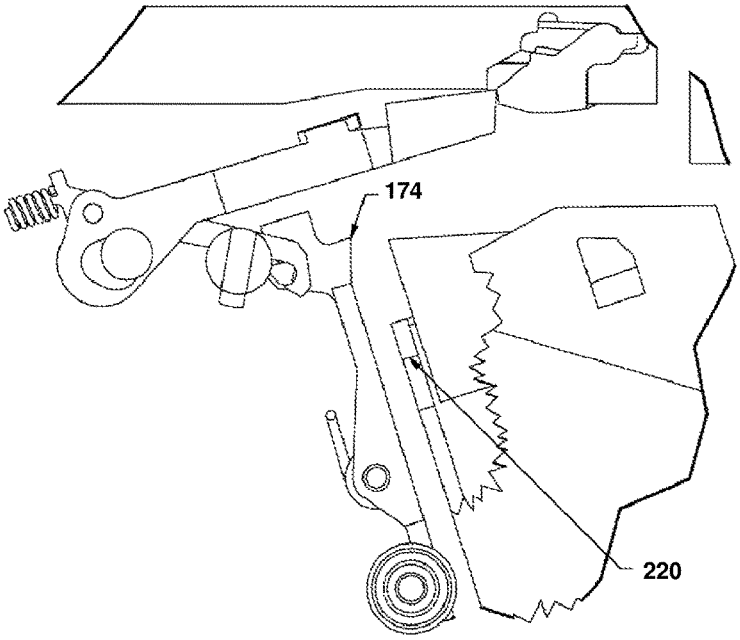

FIG. 59 illustrates a firearm incorporating both slide assembly 400 and auto-eject assembly 600A of the inventive subject matter into a single firearm. The illustration of FIG. 59 shows a firearm that has just fired its last cartridge 105, causing the slide 401 to become locked (described above as related to slide assembly 400). The locked slide in turn actuates auto-eject assembly as described herein to eject magazine 200A from frame 101B. As shown in FIG. 59A (close-up of view ZZ of FIG. 59), the magazine release notch 174 has been disengaged from magazine notch 220, causing the magazine to drop.

Figure 60:
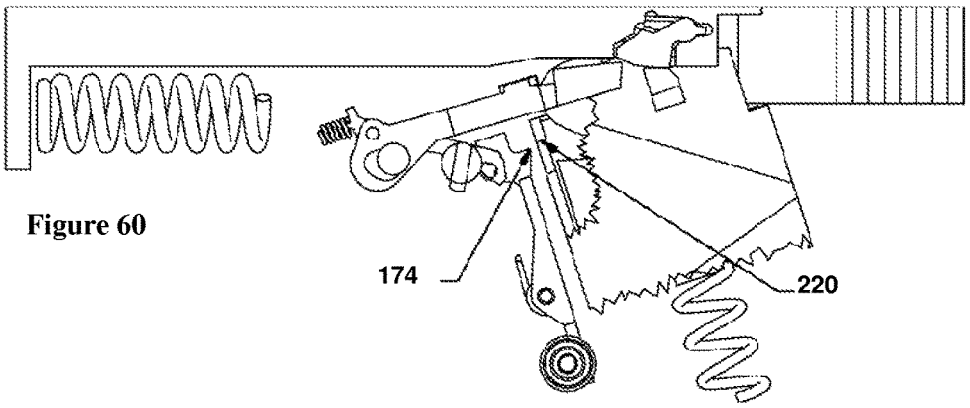
FIG. 60 shows that a new magazine has been inserted into the firearm frame, and the slide lock actuator has caused the upward rotation of the pivoting slide lock, separating it from the slide release.

FIG. 60 shows that a new magazine 200A has been inserted into frame 101B, and pivoting slide lock actuator 210A has caused the upward rotation of pivoting slide lock 420, separating it from slide release 102B. At the point in time illustrated in FIG. 60 (at the instant of slide unlock), the spring 601A has not yet pushed on the magazine release actuator 610A nor has the magazine release spring 173 begun to pull on the magazine release 170B such that the release actuator 610A, slide release 102B, or magazine release 170B have started moving (pivoting in the case of magazine release 170B) rearward (towards the right in the figure).

Figure 61:
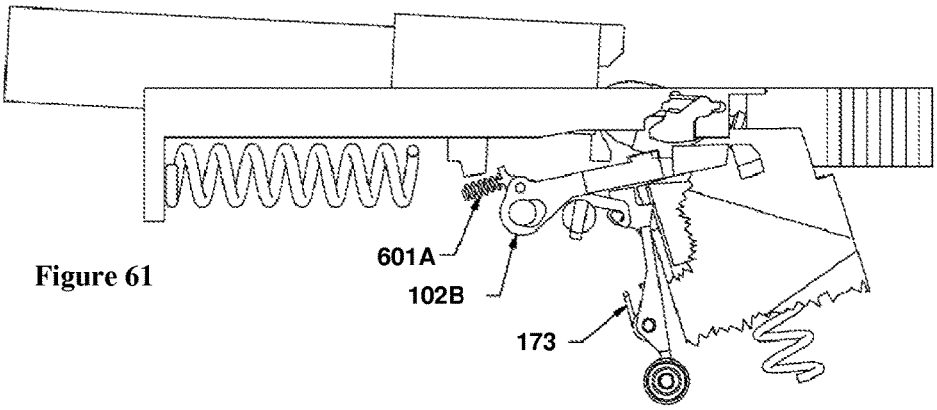
FIG. 61 shows the slide moving forward, such that a cartridge is being chambered.
Figure 62:
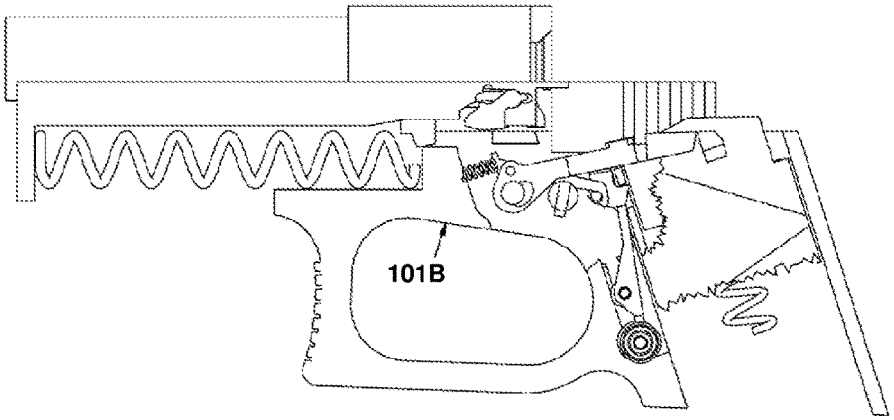
FIG. 62 shows the firearm ready to fire.

FIG. 61 shows the slide 401 moving forward, such that cartridge 105 is being chambered. At this point, springs 601A and 173 have actuated components 610A, 102B and 170B such that magazine release notch 174 has engaged with magazine notch 220, securing the magazine 200A in place within frame 101B, and slide release 102B is in the "down and stowed" unlock position. The time required to transition from FIG. 60 to FIG. 61 (i.e. time required to transition from an unsecured to a secured magazine state) can be measured in hundredths of a second and thus considered (for all intents and purposes) to be instantaneous. FIG. 62 shows the firearm ready to fire. As magazine 200A in FIG. 62 contains no additional cartridges 105, upon firing the auto-eject assembly 600A will eject magazine 200A.

Figure 63:
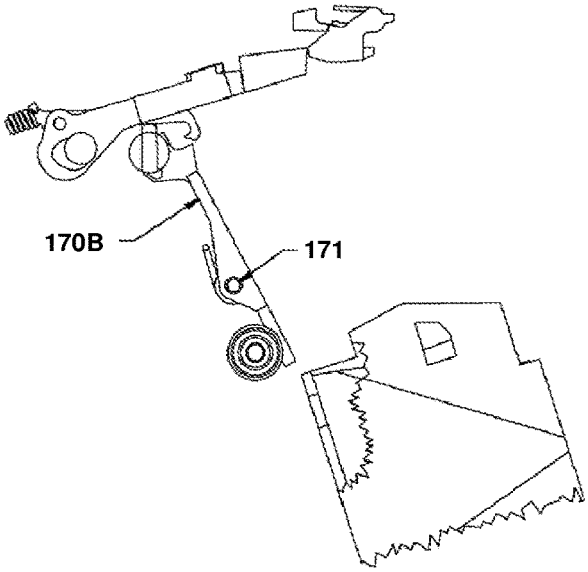
FIGS. 63-64A provide additional views of the auto-eject assembly in a disengaged position due to the activation of disable knob.
Figure 64A:
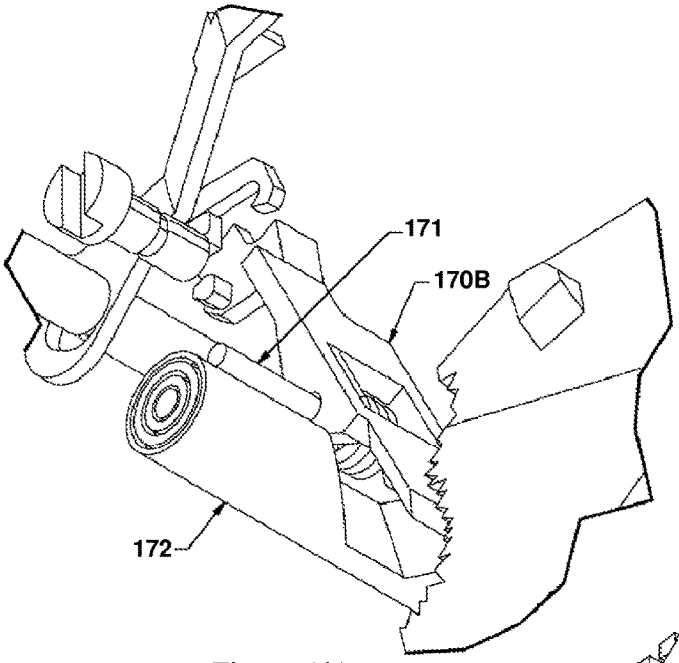
Figure 64:
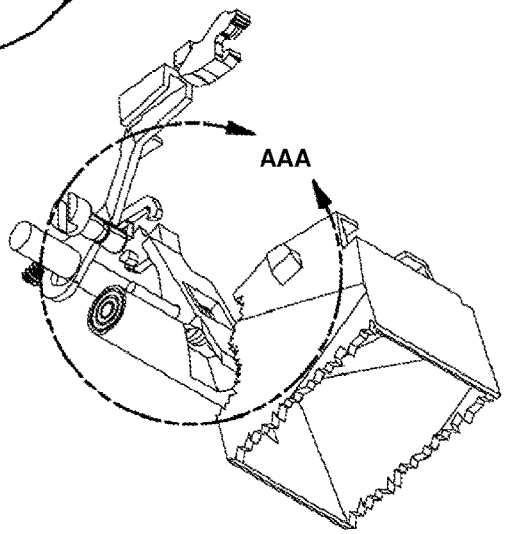

FIGS. 63-64A provide additional views of the assembly 600A in a disengaged state due to the activation of disable knob 620A. As shown in FIG. 64A (close-up of section AAA of FIG. 64), with the assembly 600A disabled, magazine 200A can be ejected from frame 101B via the actuation of release button 172. The beveled shoulders of release button 172 interact with the beveled shoulders of magazine release 170B, causing magazine release 170B to pivot counterclockwise about pivot 171, causing magazine release notch 174 to disengage from magazine notch 220.

Figure 65:
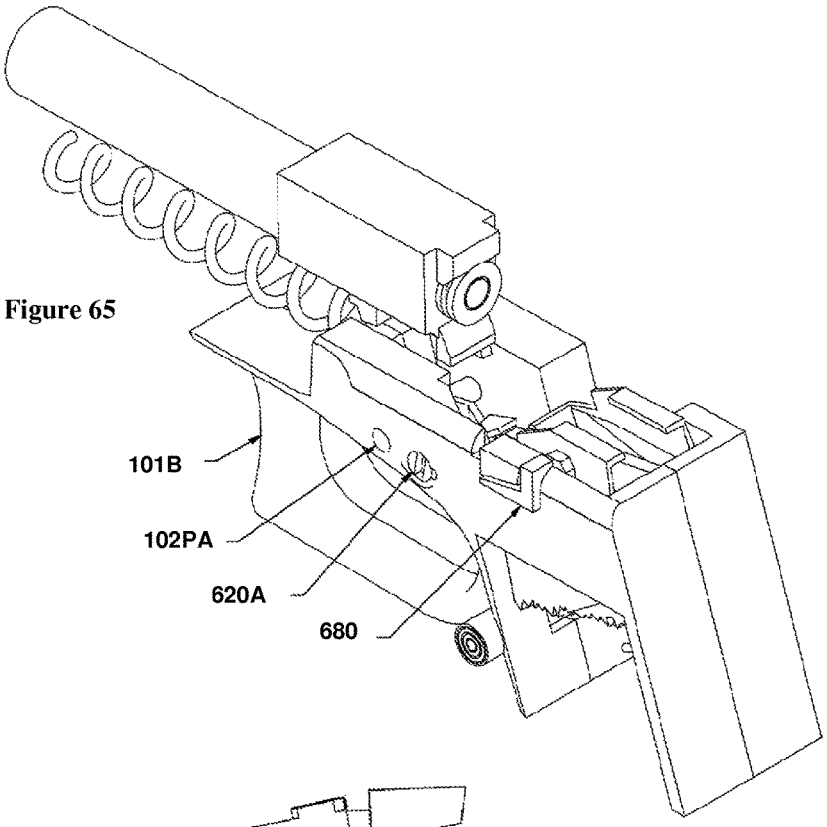
FIG. 65 provides an isometric view of firearm incorporating slide assembly and auto-eject assembly.

FIG. 65 provides an isometric view of firearm incorporating slide assembly 400 and auto-eject assembly 600A, obscured by frame 101B to illustrate the fit of slide release pivot 102PA and disable knob 620A. FIG. 65 also illustrates an embodiment wherein frame 101B includes ejection prevention nub 680 that sits around the rearward edges of exposed sections of slide release 102B to prevent an inadvertent forward movement of slide release 102B, such as by a snag during withdrawal from a holster, causing accidental ejection of a loaded magazine.

As mentioned above, the auto-eject assembly 600A is illustrated on a firearm that includes a conventional slide mechanism, as well as a firearm that also includes the automatic ammunition chambering system (slide assembly 400 and magazine 200A) of embodiments of the inventive subject matter illustrated in FIGS. 32-36. This combination of the automatic ammunition chambering system and the auto-eject assembly 600A enables a user to reload an out-of-ammunition state firearm with a single user-required action: the introduction of a new magazine 200A into frame 101B. The steps of ejecting the empty magazine and releasing the slide to chamber a round are performed automatically by the systems of the inventive subject matter.

As discussed above, the pivoting capabilities of magazine release actuator 610 of auto-eject assembly 600 enables the magazine release 170A to return to a position ready to secure a new magazine 200, independent of whether the slide remains locked by slide release 102 or has been released. Thus, users with large hands may inadvertently impede the auto-eject function of assembly 600 by grasping the bottom portion of the magazine (and thus prevent its ejection) during the actuation and resetting of the magazine release 170A. Because the time required to transition from the state of FIGS. 48-48B (magazine unsecured) back to the state of FIG. 50-50A (ready to secure a magazine) can be measured in hundredths of a second (and thus, from the perspective of a user, near-instantaneous), impeding the drop of an empty magazine will cause the magazine release 170A to re-secure the empty magazine. In contrast, under the configuration of auto-eject assembly 600A the magazine release 170B will not be released to return to a position ready to secure a new magazine 200A unless the slide is released or the disable knob 620A is actuated to separate magazine release 170B from magazine release actuator 610A. Thus, the embodiments of the inventive subject matter incorporating assembly 600A enables the empty magazine to be ejected once the obstruction under the empty magazine (i.e., the user's hands in this example) is cleared. In preferred embodiments, assembly 600A will be used in combination with the slide assembly 400 and magazine 200A of the inventive subject matter, such that the insertion of a new magazine 200A actuating slide assembly 400 will cause the resetting of magazine release 170B to secure the magazine 200A in place (as illustrated in FIGS. 60-61).

It is contemplated that pivoting slide lock 420 of the inventive subject matter can be configured with various types of uses. For example, certain pivoting slide locks 420 can be designed for competition (i.e., with greater sensitivity to actuation) for easier loading and chambering, whereas other pivoting slide locks 420 can be designed for the rigors of duty and/or combat and the situations faced therein. Additionally, the systems and methods of the inventive subject matter allow for replacement of only the pivoting slide lock 420 when it has become worn over time, instead of having to replace the entire slide assembly of a conventional system.

The components of the inventive subject matter can be made from suitable materials well known by those of the art (e.g.—sheet metal, steel, steel alloys, steel wire, high performance polymers (plastics), etc.).

Alternative embodiments and/or uses of the methods and devices described above and modifications and equivalents thereof are intended to be included within the scope of the present invention. Although only semiautomatic handguns are described (magazine of which require only a straight inserting motion), the invention could be readily adapted to be utilized in alternate types of firearms (i.e.—(semi and fully automatic) rifles, shotguns, cannons, etc.). Alternate required motions to insert magazines into weapons (e.g.—clipping the forward edge of a magazine into a magazine well and then rotating/pivoting/pulling the magazine body around the forward edge clip to lock the magazine into place such as for some types of "banana" shaped magazines) could easily be utilized to accomplish the present patent's objectives. The invention could also be integrated with safety magazine disconnect mechanisms (which prevent firing of the weapon without its magazine) known by those in the art. Thus it is intended that the scope of the present invention be determined only by a fair reading of the following claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A firearm reloading system, comprising:

a slide assembly for a firearm, comprising:

a slide; and a pivoting slide lock pivotably coupled to the slide such that the pivoting slide lock pivots between a lock position and an unlock position, wherein the pivoting slide lock in the lock position contacts a slide release of the firearm when the slide release is in a slide release lock position, thereby locking the slide; and a magazine configured to hold at least one cartridge, the magazine including an actuator tab configured to align with the pivoting slide lock when the magazine is inserted into the firearm, such that when the magazine is fully inserted, the actuator tab causes the pivoting slide lock to pivot to an unlock position.

2. The system of claim 1, wherein the pivoting slide lock further comprises a slide lock notch configured to engage the slide release of the firearm when the slide release is in a slide release lock position and the pivoting slide lock is in the lock position, keeping the slide in a slide lock position.

3. The system of claim 1, wherein the slide assembly further comprises a pivoting slide lock spring configured to bias the pivoting slide lock toward the lock position.

4. The system of claim 1, wherein the slide further comprises a pivot slide lock cavity and the pivoting slide lock is pivotably coupled to the slide and disposed within the pivot slide lock cavity.

5. The system of claim 1, wherein the actuator tab comprises a tab projecting upward from the upper edge of a side of the magazine.

6. The system of claim 1, wherein the actuator tab comprises a tab projecting horizontally from a side of the magazine.

7. A firearm magazine auto-eject system for a firearm, comprising:

a slide release comprising:

an actuator coupling; and an elongated slide release pivot hole configured to rotatably and translatably couple to a slide release pivot of a frame of the firearm, such that the slide release can transition between a slide release lock position and a slide release unlock position;

a magazine release comprising a magazine release catch, the magazine release configured to rotatably couple to a magazine release pivot of the frame of the firearm such that the magazine release pivots between a magazine secured position and a magazine unsecured position; and a magazine actuator comprising a slide release coupling coupled to the actuator coupling of the slide release and an actuator catch removably coupled to the magazine release catch of the magazine release;

wherein transitioning the slide release from the slide release unlock position to the slide release lock position actuates the magazine actuator, causing the magazine release to transition from the magazine secured position to the magazine unsecured position.

8. The system of claim 7, further comprising an actuator spring coupled to the magazine actuator at a first end and configured to couple to the frame of the firearm at a second end, the actuator spring configured to bias the slide release to the unlock position.

9. The system of claim 8 further comprising:

a actuator catch disengager coupled to the frame of the firearm, configured to cause the magazine actuator to pivot upward as the slide release transitions from a slide release unlock position to a slide release lock position, thereby disengaging the actuator catch of the magazine actuator from the magazine release catch of the magazine release; and a magazine release spring coupled to the magazine release and configured to couple to the frame of the firearm, the magazine release spring configured to bias the magazine release toward the magazine secured position.

10. The system of claim 8, further comprising an auto-eject disable knob configured rotatably coupled to the frame of the firearm between a disable position and an enabled position, the auto-eject disable knob having a circular cross-section and comprising a cam lobe projecting outwardly from the circular cross-section, wherein cam lobe is configured to displace the magazine actuator such that the actuator catch is disengaged from the magazine release catch of the magazine release when the auto-eject disable knob is in the disable position.

11. A firearm reloading system, comprising:

a slide release comprising:

an actuator coupling; and an elongated slide release pivot hole configured to rotatably and translatably couple to a slide release pivot of a frame of the firearm, such that the slide release can transition between a slide release lock position and a slide release unlock position;

a magazine release comprising a magazine release catch and a magazine release notch, the magazine release configured to rotatably couple to a magazine release pivot of the frame of the firearm such that the magazine release pivots between a magazine secured position and a magazine unsecured position, wherein the magazine release notch is configured to engage with a magazine notch of a magazine when the magazine release is in the magazine secured position;

a magazine actuator comprising a slide release coupling coupled to the actuator coupling of the slide release and an actuator catch removably coupled to the magazine release catch of the magazine release;

a slide assembly for a firearm, comprising:

a slide;

a pivoting slide lock pivotably coupled to the slide such that the pivoting slide lock pivots between a lock position and an unlock position, wherein the pivoting slide lock in the lock position contacts the slide release when the slide release is in a slide release lock position, thereby locking the slide; and a magazine configured to hold at least one cartridge, the magazine comprising:

a magazine notch configured to engage with the magazine release notch; and an actuator tab configured to align with the pivoting slide lock when the magazine is inserted into the firearm, such that when the magazine is fully inserted, the actuator tab causes the pivoting slide lock to pivot to an unlock position;

wherein transitioning the slide release from the slide release unlock position to the slide release lock position actuates the magazine actuator, causing the magazine release to transition from the magazine secured position to the magazine unsecured position.

12. The system of claim 11, wherein the pivoting slide lock further comprises a slide lock notch configured to engage the slide release of the firearm when the slide release is in a slide release lock position and the pivoting slide lock is in the lock position, keeping the slide in a slide lock position.

13. The system of claim 11, wherein the slide assembly further comprises a pivoting slide lock spring configured to bias the pivoting slide lock toward the lock position.

14. The system of claim 11, wherein the slide further comprises a pivot slide lock cavity and the pivoting slide lock is pivotably coupled to the slide and disposed within the pivot slide lock cavity.

15. The system of claim 11, wherein the actuator tab comprises a tab projecting upward from the upper edge of a side of the magazine.

16. The system of claim 11, wherein the actuator tab comprises a tab projecting horizontally from a side of the magazine.

17. The system of claim 11, further comprising an actuator spring coupled to the magazine actuator at a first end and configured to couple to the frame of the firearm at a second end, the actuator spring configured to bias the slide release to the unlock position.

18. The system of claim 17, further comprising:

a actuator catch disengager coupled to the frame of the firearm, configured to cause the magazine actuator to pivot upward as the slide release transitions from a slide release unlock position to a slide release lock position, thereby disengaging the actuator catch of the magazine actuator from the magazine release catch of the magazine release; and a magazine release spring coupled to the magazine release and configured to couple to the frame of the firearm, the magazine release spring configured to bias the magazine release toward the magazine secured position.

19. The system of claim 17, further comprising an auto-eject disable knob configured rotatably coupled to the frame of the firearm between a disable position and an enabled position, the auto-eject disable knob having a circular cross-section and comprising a cam lobe projecting outwardly from the circular cross-section, wherein cam lobe is configured to displace the magazine actuator such that the actuator catch is disengaged from the magazine release catch of the magazine release when the auto-eject disable knob is in the disable position.

* * * * *